US005375382A

United States Patent [19]

Weidlinger

[11] Patent Number: 5,375,382

[45] Date of Patent: Dec. 27, 1994

[54] LATERAL FORCE RESISTING STRUCTURES AND CONNECTIONS THEREFOR

[76] Inventor: Paul Weidlinger, 301 E. 47th St., New York, N.Y. 10017

[21] Appl. No.: 823,726

[22] Filed: Jan. 21, 1992

[51] Int. Cl.[5] ..... E04H 9/02

[52] U.S. Cl. ..... 52/167 CB; 52/167 EA

[58] Field of Search ..... 52/167 CB, 167 RM, 167 R, 52/167 EA

[56] References Cited

U.S. PATENT DOCUMENTS

| | | | |
|---|---|---|---|
| 4,094,111 | 6/1978 | Creegan | 52/167 CB |
| 4,223,506 | 9/1980 | Blair et al. | 52/167 CB |
| 4,409,765 | 10/1983 | Pall | 52/573 |
| 4,890,430 | 1/1990 | Kobori et al. | 52/167 CB |

FOREIGN PATENT DOCUMENTS

| | | | |
|---|---|---|---|
| 0284638 | 11/1989 | Japan | 52/167 CB |
| 0108740 | 4/1990 | Japan | 52/167 CB |
| 0286936 | 11/1990 | Japan | 52/167 CB |
| 0066877 | 3/1991 | Japan | 52/167 CB |
| 825059 | 12/1959 | United Kingdom | 52/167 CB |
| 1237764 | 4/1986 | U.S.S.R. | 52/167 CB |

*Primary Examiner*—Carl D. Friedman
*Assistant Examiner*—Christopher Todd Kent
*Attorney, Agent, or Firm*—Pennie & Edmonds

[57] ABSTRACT

A force resisting structure for providing lateral support to a structure includes first and second substantially vertical structural members. These structural members each have first and second ends, the first ends being secured to an exterior support or structure. A third structural member having a first end connected to the first structural member and a second end connected to the second structural member is also included. The structure also includes means for movably connecting the third structural member to the first structural member so as to provide selective predetermined relative motion between these members when a lateral load is applied to the structure. Alternatively, the structure may include primary and secondary lateral bracing members extending in parallel from the first end of the first structural member to the second end of the second structural member. The secondary lateral bracing member is movably connected to the first structural member so as to provide selective predeterined relative motion between the primary and secondary lateral bracing members when a load is applied to the structure. The movable connection means provides a structure having a reduced amplitude of response to dynamic lateral loads, such as forces induced by earthquake and winds.

20 Claims, 20 Drawing Sheets

LATERAL FORCE RESISTING STRUCTURES AND CONNECTIONS THEREFOR

BACKGROUND OF THE INVENTION

This invention relates to lateral support systems for structures subject to dynamic lateral loads. More particularly, it relates to lateral support structures and connections therefor in which selected members are coupled so as to provide selective predetermined substantially frictionless relative motion between the members.

Typically, buildings and other structures are designed primarily to resist gravity loads. That is, the arrangement and sizing of the structural elements is determined by considering only gravity loads. Gravity loads include the weight of the building itself, the weight of attachments to the structure such as pipes, electrical conduits, air-conditioning, heating ducts, lighting fixtures, coverings, roof coverings, and suspended ceilings (i.e., dead load) as well as the weight of human occupants, furniture, movable equipment, vehicles stored goods (i.e., live load).

Structures designed to resist forces caused by dynamic lateral loads such as wind, earthquakes, explosions, vibrating machinery, temperature changes and long-term, gradual distortions due to shrinkage, creep and/or settlement, involve special considerations. Primarily, the principal application of these forces is in a horizontal direction, or, more precisely, in a direction perpendicular (or lateral) to the direction of gravity.

For example, the application of wind force to a closed building create lateral pressures applied normal to the exterior surfaces of the building. These forces may be either inward (i.e., positive pressures) or outward (i.e., negative or suction pressure). The shape of the building and direction the wind determine the distribution of pressures on the various exterior surfaces of the building. The total effect on the building is usually determined by considering the vertical profile, or silhouette, of the building as a single vertical plane surface at right angles to the wind direction.

During an earthquake, the ground surface moves in all directions. The most damaging effect on structures, however, is caused by movements in the direction parallel to the ground surface (i.e., horizontally). Thus, for design purposes, the major effect of an earthquake is usually considered in terms of horizontal force, similar to the effect of wind.

Since most structures are conceived in terms of their gravity resistance, designing for dynamic loads such as winds or earthquakes is often dealt with by bracing the gravity resisting system against lateral forces. In a typical structure, the lateral force system is provided by bracing systems that include solid walls (called "shear walls"), diagonally or otherwise braced bays, and rigid frames. Structures that are designed primarily to resist gravity loads always contain such lateral bracing systems to provide stability against lateral forces induced by unsymmetric load distribution. These lateral bracing systems are usually augmented to provide resistance against lateral forces induced by earthquakes, winds, etc.

The principal concern in structural design for earthquake forces is for the laterally resistant system of the building or structure. In most buildings, this system consists of some combination of horizontally distributing elements (usually roof and floor diaphragms) and vertical bracing elements (shear walls, rigid frames, braced frames, etc.). Failure of any part of this system, or of connections between the parts, can result in major damage to the building, including the possibility of total collapse.

The primary elements of a lateral load resistive system are often braced frames. Post and beam systems, consisting of separate vertical and horizontal members, may be inherently stable for gravity loading, but they must be braced in some manner for lateral loads. The three basic ways of achieving this are through shear panels, moment resistive joints between the members, or by bracing.

When shear panels are used, the panels themselves are usually limited to the direct shear force resistance. Thus, the lateral resistive system is essentially that of a box system, although a complete frame structure exists together with the diaphragm elements of the box.

When moment-resistive joints are used, lateral loads induce bending and shear in the elements of the frame. In rigid frames with moment-resistive connections, both gravity and lateral loads produce interactive moments between the members. In most cases, rigid frames are actually the most flexible of the basic types of lateral resistive systems. This deformation character, together with ductility, make the rigid frame a structure that absorbs energy through deformation.

Most moment-resistive frames consist of either steel or concrete. Steel frames have either welded or bolted connections between the linear members to develop the necessary moment transfers. Frames of concrete achieve moment connections through the monolithic concrete as well as through the continuity and anchorage of the steel reinforcing. Because concrete is basically brittle and not ductile, the ductile character is essentially produced by the ductility of the steel reinforcing.

In braced frames, on the other hand, trussing or triangulation of the frame is used to achieve lateral stability. The trussing is usually achieved by inserting diagonal members in the rectangular bays of the frame. If single diagonals are used, they serve a dual function, acting in tension for the lateral loads in one direction and in compression when the load direction is in the opposite direction. Because tension members are generally more structurally efficient, the frame is sometimes braced with a double set of diagonals (called "X-bracing"). In any event, the trussing causes lateral loads to induce only axial force in the members of the frame, as compared to the behavior of the rigid frame. It also generally results in a frame that is stiffer, having less deformation than the rigid frame.

Significantly, in designing a structure to resist lateral loads, it is not necessary to brace every individual bay of the rectangular frame system. Usually, sufficient bracing is achieved by bracing only a few bays, or even only a single bay. Trussing tends to produce a structure that has a overall stiffness somewhere between that of a stiff diaphragm (shear wall) and that of the flexible moment-resistive frame.

Another major consideration in designing a structure subject to, for example, earthquakes is the detailing of construction connections so that the building is quite literally not shaken apart by earthquake. With regard to the structure, this means that the various separate elements must be positively secured to one another.

According to the prior art, for example, when using trussed structures, it was necessary to ensure that the structure itself is "tight." That is, connections should be made in a manner to assure that they will not be initially free of slack and will not loosen under load reversals or repeated loadings. This meant avoiding connections that are loose or which allow movement between the structural members. Avoiding loose connections is particularly important in systems subject to dynamic loading since relative movement between the structural members leads to increased wear and deterioration of the connection.

As is well known in the art, a zero resistance rotation may be introduced into a structure during the erection of rigidly braced frames. Specifically, certain initial column-girder connections may be constructed to permit rotation at the girder support during the application of a superimposed dead load. After the initial load application, however, a final fixed connection of the columns is installed to prevent free rotation under any additional loading.

Movement in connections or slip response has also been proposed in seismic base isolation systems. In such systems, rigid body motion of the entire structure due to sliding of the foundation provides a constant frictional resistance.

In some other cases it is desirable to allow for some degree of independent motion of selected parts of a structure. In particular, it is desirable to use separation joints to secure various nonstructural elements, such as window glazing, to the structure. These joints permit some degree of independent movement of the nonstructural elements to prevent undesired transfer of force to these elements.

Another type of earthquake resistant system involves "active control". In these systems, a motion sensor detects motion of the structure and activates active controls, such as actuators or other mechanical devices, which counteract the motion. Active control systems are expensive and require maintenance for the electromechanical components.

SUMMARY OF THE INVENTION

I have devised new structural connections for interconnecting structural components in lateral force resisting systems. These connections may be used to either improve the response of an overall structure to dynamic loads or drastically reduce the amount of material required to resist dynamic loads. Specifically, I have devised new structural connections for interconnecting structural members in a lateral force resisting system which provide for substantially frictionless relative motion between interconnected members, in response to lateral loads. As such, certain structural members connected according to my invention become "active" (i.e., resist force or moments) only after a predetermined amount of relative motion (displacement and/or rotation) has taken place.

In accordance with the present invention, structural connections are disclosed for interconnecting the structural members of a lateral force resisting system. The structural connections provides for substantially frictionless relative motion, such as translation or rotation, between structural members attached thereby. These connections comprise means for providing predetermined displacement and/or rotation between the members attached thereby and means for resisting relative motion once the predetermined displacement and/or rotation has occurred. For example, the connection may include connecting openings or holes in one member of a lateral force resisting system which are slotted or elongated in the direction of the desired relative motion.

Advantageously, connections in accordance with my invention may be used with structural members of steel, wood, reinforced concrete, prestressed concrete and the like. Also, these connections may be used in all types of lateral bracing systems, including shear walls, rigid frames and braced frames.

This type of connection, hereinafter referred to as sequential connection, has the advantages of:

(a) Reducing the stiffness of the overall structure as compared to structures of equal strength and constructed of an equal amount of material, but which use traditional connections. It is well known in the art that a suitable reduction in the stiffness of the structure results in the lowering of its frequency of response and evokes a reduction of the amplitude of seismic excitation. Furthermore, when the excitation is caused by thermal effects, settlement of foundations, and similar situations which impose deformation or displacement, the reduced stiffness results in a lower amplitude of the forces in the bracing system.

(b) Increasing the energy absorption of the structure when the applied lateral loads produce forces in the lateral force resisting system which exceeds the elastic limit of the individual components of the system, since the response of the structure is affected by a complex force deformation path dictated by the sequential connection.

(c) Providing simple connection details and requiring a minimum amount of field connections.

All of the above properties are desirable and beneficial for the design of structures that are subject to time dependent excitation.

Furthermore, structures in which sequential connections are used:

(1) may use an amount of material equal to that of a standard lateral force resisting system but exhibit a reduced peak deformation response, resulting in increased safety of the structure;

(2) exhibit a significant reduction in permanent deformations, which reduces or eliminates maintenance and repair costs; and (3) may be designed to exhibit a response that is identical to that of a structure using standard connections but which requires significantly less material, leading to cost savings.

Also in accordance with the present invention, I have devised lateral force resisting structures for a structure subject to lateral loads. In particular, I have devised lateral force resisting structures in which certain members are sequentially connected so as to provide for substantially frictionless relative motion of the members connected thereby, in response to lateral loading. For example, the lateral force resisting structure may comprise a frame which includes first and second substantially vertical structural members. Both of these members are provided with first and second ends, the first ends being secured to an exterior support structure.

The lateral force resisting structure also includes a third structural member which extends from the second end of the first structural member to the second end of the second structural member, thereby forming a frame. This frame may be used in a variety of structures, such as buildings or bridges, for providing lateral support thereto.

In accordance with my invention, the lateral force resisting structure further includes means for connecting the second end of the third structural member to the second end of the second structural member so as to provide for substantially frictionless relative motion between the third structural member and the second structural member when a lateral load is applied to the planar frame.

Also in accordance with my invention, I have devised methods for retrofitting an existing structure to improve the response of the structure to dynamic lateral loads. In one such method, increased lateral force resistance is provided to an existing structure by sequentially connecting additional structural members to the lateral force resisting system of the structure. For example, in an existing structure having a lateral force resisting structure comprising a plurality of braced bays, additional structural members, such as plates, may be sequentially connected to the existing bracing members.

In an alternate method, increased lateral force resistance is provided to an existing structure by replacing selected connections of the existing lateral force resisting system with sequential connections.

According to another important aspect of my invention, I have devised a method of designing a lateral force resisting structure for complex and multistory structures. This method generally follows the steps used by an engineer in designing a lateral force resisting structure. According to my method, however, the engineer selectively replaces certain connections of the lateral force resisting structures with sequential connections. For example, the method may include the steps of: determining the lateral loads on the structure; selecting a lateral support system for the structure, such as braced frames, rigid frames, shear walls or come combination thereof; and sequentially connecting certain members in the selected lateral support system.

BRIEF DESCRIPTION OF THE DRAWING

These and other objects, features and advantages of my invention will be more readily apparent from the following detailed description of the preferred embodiments of the invention in which.

DETAILED DESCRIPTION OF THE PREFERRED EMBODIMENTS

Figure 1:
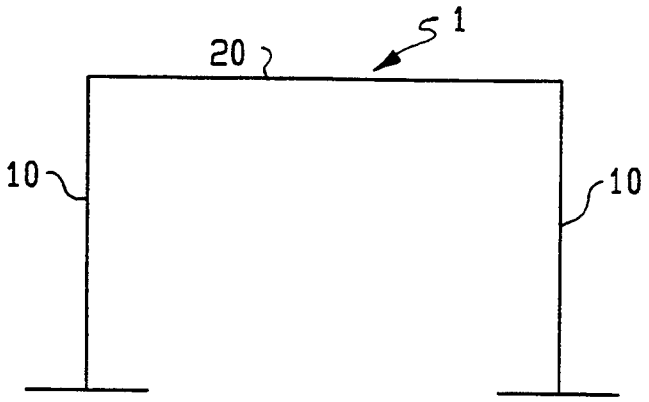
FIG. 1 is a front elevation view of a planar frame.

FIG. 1 illustrates, in front elevation view, a planar frame 1, which includes a pair of substantially vertical structural members 10. The lower ends of vertical members 10 may be secured to a foundation or a lower structural member via a suitable connection or connecting member.

Figure 2:
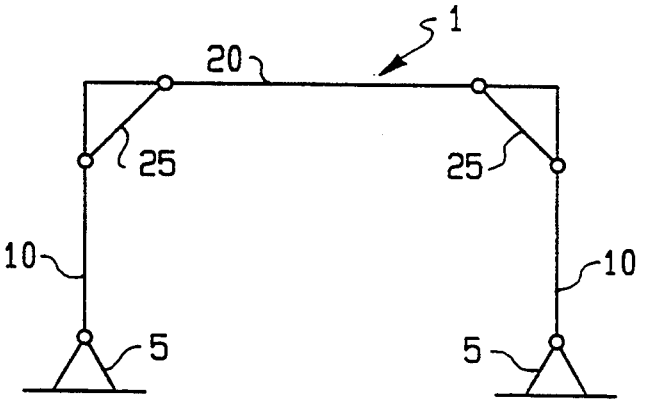
FIG. 2 is a front elevation view of a knee-braced frame.
Figure 3:
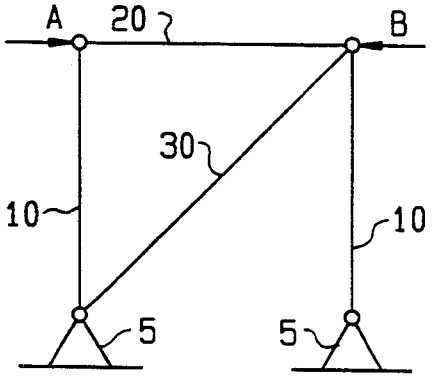
FIG. 3 is a front elevation view of a braced frame having a single diagonal bracing member.
Figure 4:
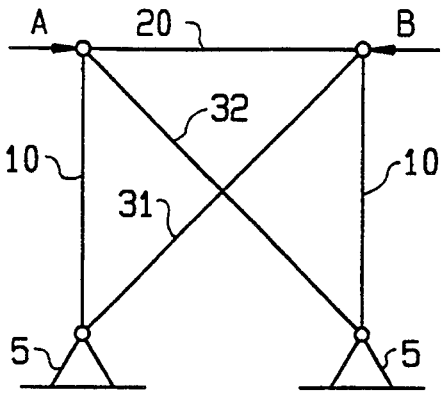
FIG. 4 is a front elevation view of an X-braced frame.

A substantially horizontal structural member 20 extends from the upper end of one vertical member 10 to the upper end of the second vertical member 10. Planar frame 1 may be inherently stable for gravity loading, but it must be braced in some fashion to resist lateral loads. FIGS. 2–6 illustrate, in front elevation view, typical lateral force resisting structures used to support a structure under lateral loads. Specifically, FIGS. 2–4 illustrate internally braced frames. In particular, FIG. 2 illustrates a "knee-braced" frame in which a pair of short "knee-braces" 25 connect the upper portions of vertical members 10 to horizonal member 20.

FIG. 3 illustrates an internally braced frame having a single diagonal member 30 which extends diagonally from the lower end of one vertical member 10 to the upper end of the second vertical member 10. When a lateral load is applied to frame 1 in the direction indicated by arrow A, diagonal member 30 resists the lateral load in tension. When the lateral load is applied to frame 1 in the direction indicted by arrow B, diagonal member 30 resists the lateral load in compression.

FIG. 4 illustrated an "X-braced" frame in which a pair of diagonal members 31, 32 are provided. A first diagonal member 31 extends from the lower end of one vertical member 10 to the upper end of the second vertical member 10. Conversely, the second diagonal member 32 extends from the lower end of the second vertical member 10 to the upper end of the first vertical member 10. When a lateral load is applied to frame 1 in the direction indicated by arrow A, diagonal member 31 resists the load in tension. When, however, the lateral load is applied in the direction indicated by arrow B, diagonal member 32 resists the load in tension.

Figure 5:
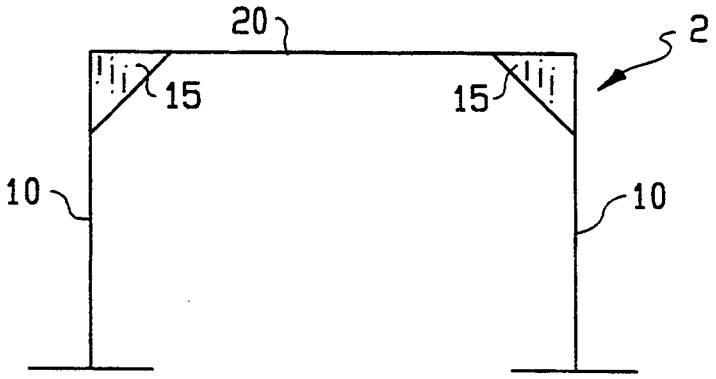
FIG. 5 is a front elevation view of a rigid frame.

FIG. 5 illustrates a frame in which lateral support is provided by moment-resistive connections 15 which rigidly connect horizontal member 20 to the upper ends of vertical members 10, forming a rigid frame 2. Such movement-resistive connections are typically welded or bolted connections between horizontal member 20 and vertical members 10 which develop the necessary movement transfers. As such, lateral loads applied to rigid frame 2 produce bending in vertical members 10 and horizontal member 20.

Figure 6:
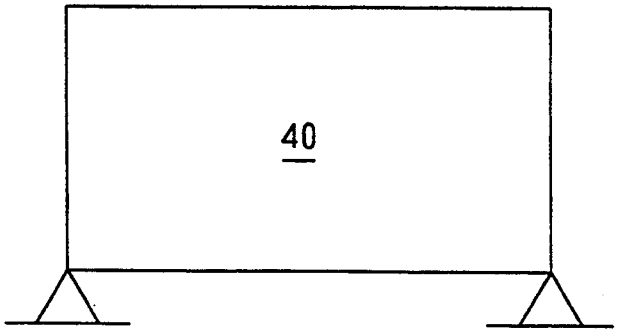
FIG. 6 is a front elevation view of a shear wall.

FIG. 6 illustrates a shear wall 40. Shear wall 40 may comprise a frame, such as frame 1 illustrated in FIG. 1, having some surfacing elements, such as plywood, plaster or drywall, or may comprise masonry. Preferably, however, shear wall 40 comprises reinforced concrete. In a shear wall 40 comprising reinforced concrete, resistance to lateral loads is provided by the steel reinforcing bars (not shown) which carry the lateral load in compression or tension.

The various lateral resisting structures described above in connection with FIGS. 2–6 are illustrative of the basic types of lateral force resisting systems available to a structural engineer in designing a structure subject to dynamic lateral loads such as earthquakes or forces caused by wind.

Figure 7:
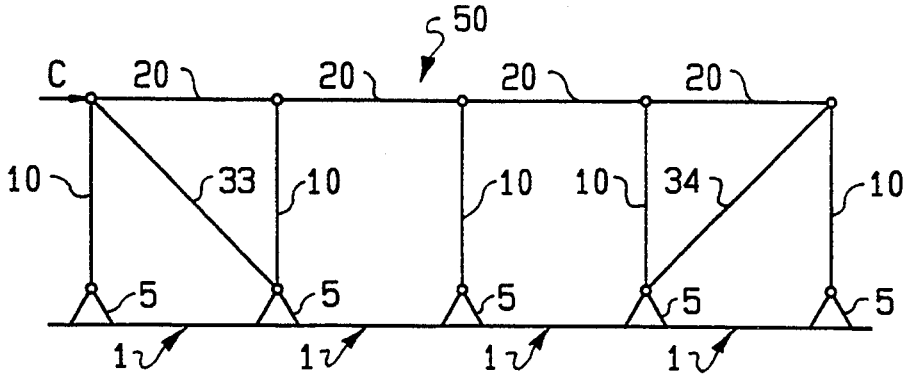
FIG. 7 is a front elevation view of a single story structure having a pair of diagonally braced frames.
Figure 8:
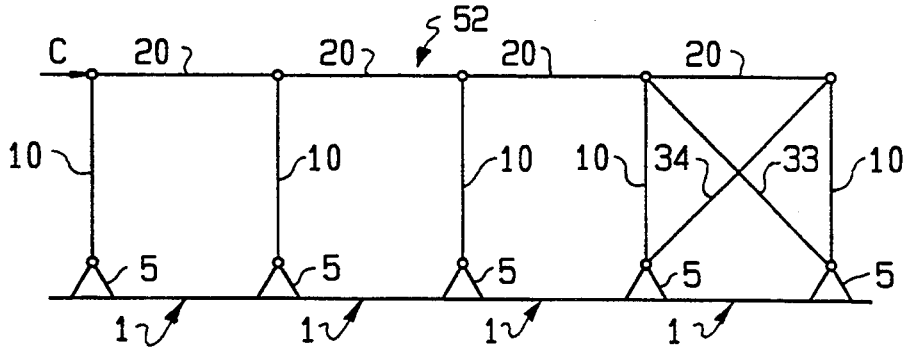
FIG. 8 is a front elevation view of a single story structure having a single X-braced frame.

Significantly, in a structure comprising a number of frames 1, it is not necessary to provide lateral support in the form of bracing, rigid motive-resistive connections or shear walls in each frame. Accordingly, as illustrated in FIGS. 7 and 8, a single story structure 50 comprising four frames 1, each formed by a pair of vertical members 10 and horizontal member 20, may be provided with sufficient lateral support by "partial trussing". For example, in FIG. 7, single story structure 50 is braced to resist lateral load, such as a load applied in the direction indicated by arrow C, by adding a first diagonal member 33 to a first frame 1, diagonal member 33 extending from the upper end of one vertical member 10 to the lower end of the second vertical member 10. A second diagonal member 34 is added to another frame 1 so that it extends from the lower end of one vertical member 10 to the upper end of the second vertical member 10. Accordingly, structure 50 resists lateral loads by tension in either member 34 (when the load is applied in the direction of arrow C) or member 33 (when the load is applied in the direction opposite to the direction indicated by arrow C) much like the X-braced frame described in FIG. 4. FIG. 8 illustrates an alternative bracing system for structure 52 in which a single frame is X-braced by diagonal members 33 and 34.

Figure 9:
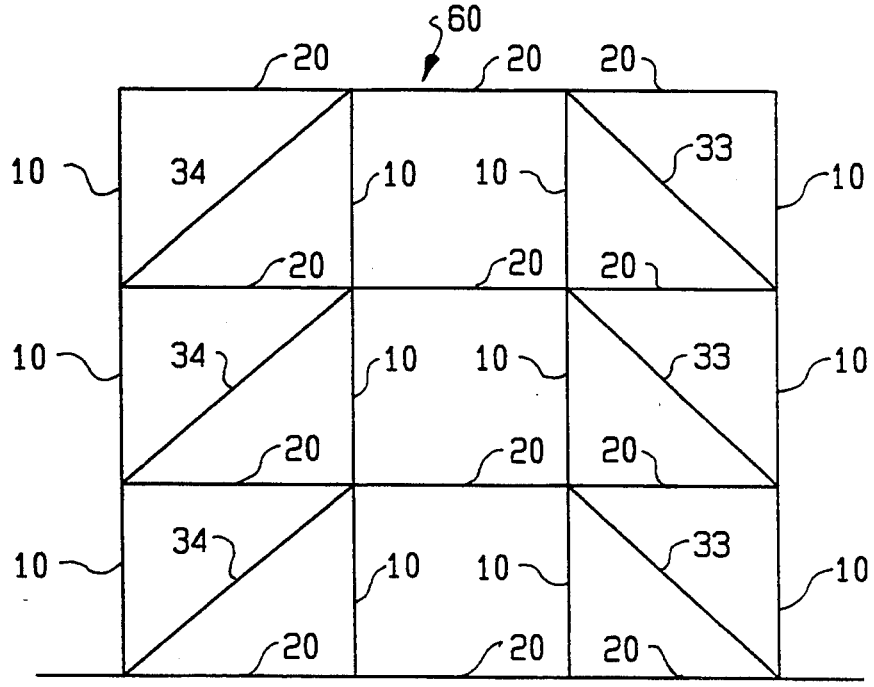
FIG. 9 is a front elevation view of a multistory structure having a plurality of braced frames.
Figure 10:
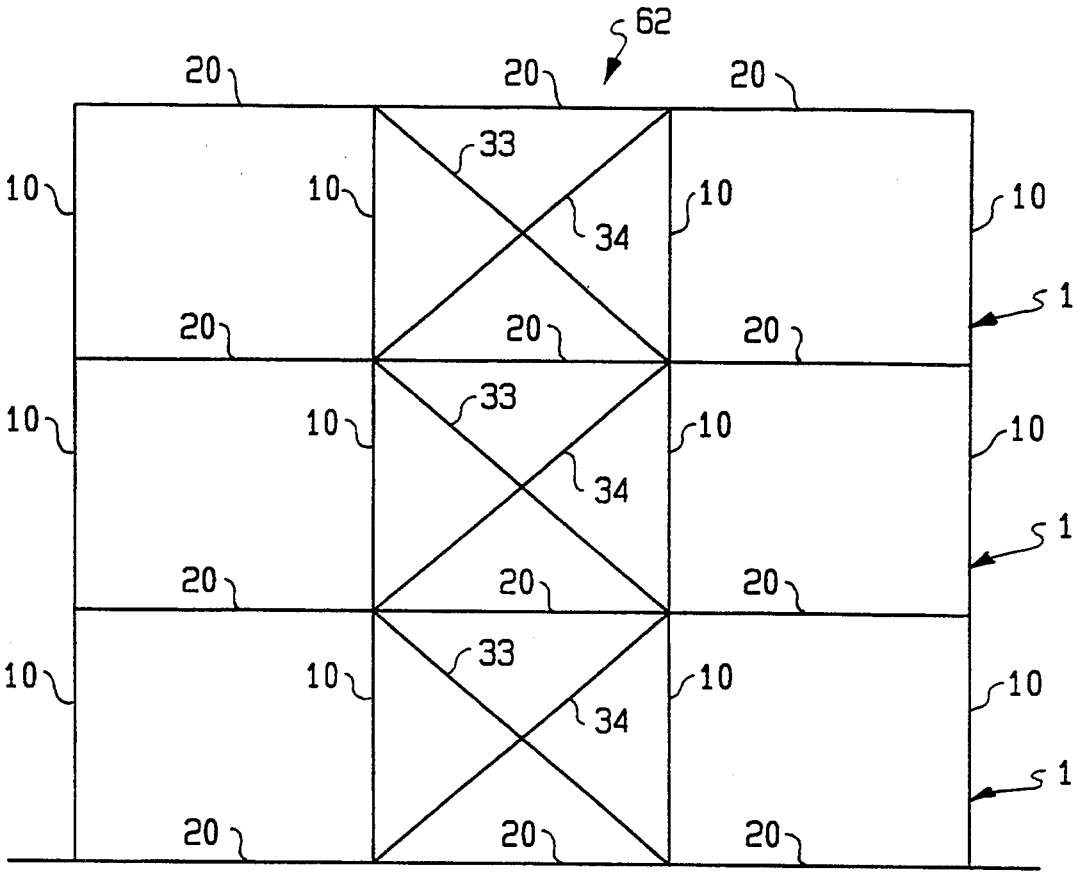
FIG. 10 is a front elevation view of a multistory structure having a plurality of X-braced frames.

Similarly, multistory structures, such as those illustrated in FIGS. 9 and 10, require lateral support in only certain frames. FIG. 9 illustrates a multistory structure 60 in which a first frame 1 on each story is braced with a diagonal member 33 and a second frame 1 on each story is braced with a diagonal member 34, similar to the single story structure 50 described above in connection with FIG. 7. FIG. 10, on the other hand, illustrates a multistory structure 62 in which a single frame 1 on each story is X-braced with diagonal members 33 and 34, similar to single story structure 50 described above in connection with FIG. 8.

The bracing schemes described above are merely illustrative of an endless variety of available schemes. As is apparent to one of ordinary skills in the art, a lateral support system for single story structure 50, 52 and multistory structure 60, 62 may comprise laterally supporting preselected frames in the structures by providing the preselected frames with rigid movement-resistive connections, shear walls or diagonal bracing members.

Figure 11:
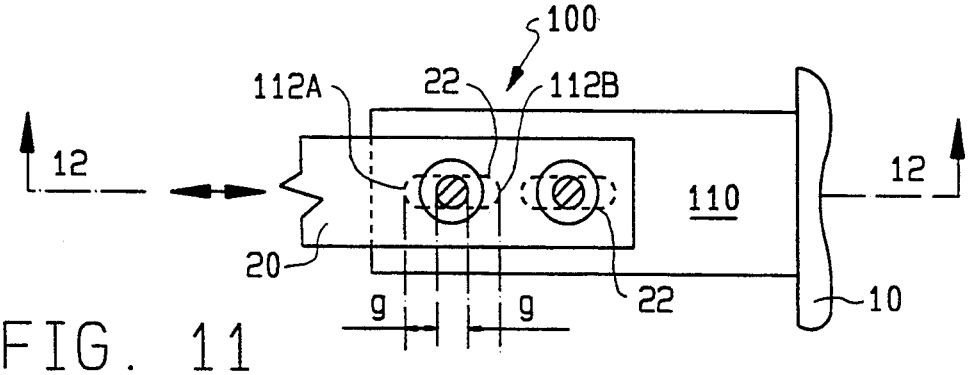
FIG. 11 is a plan view of sequentially connected members of a rigid frame according to my invention.
Figure 12:
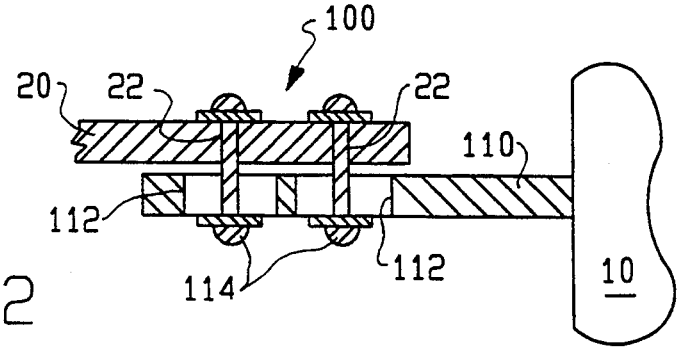
FIG. 12 is a cross-sectional view along line 12—12 of the sequentially connection of FIG. 11.

Turning now to FIGS. 11 and 12, there is illustrated a preferred embodiment of the present invention, designated by the numeral 100, in which one end of horizontal member 20 is connected to the upper end of a vertical member 10 in a manner to provide selective predetermined relative motion between horizontal member 20 and vertical member 10.

Specifically, FIGS. 11 and 12 illustrate sequential connection 100 for a rigid frame, such as that described in connection with FIG. 5. Connection 100 includes means for connecting horizontal member 20 to the upper end of one vertical member 10 so as to permit horizontal member 20 to displace a predetermined amount in response to a lateral load.

Preferably, the connecting means include at least one plate member 110 which connects horizontal member 20 to the upper end of vertical member 10. Plate member 110 includes a plurality of elongated slots 112 for receiving fasteners 114. Elongated slots 112 preferably extend along the longitudinal axis 113 of horizontal member 20. As shown in FIGS. 11 and 12, plate member 110 is rigidly secured to the upper end of one vertical member 10.

Horizontal member 20, which is shown as a flat plate member, preferably includes a plurality of mounting holes 22 at the end sequentially connected to plate 110, for receiving fasteners 114. Mounting holes 22 align with elongated slots 112 in plate member 110 when horizontal member 20 is coupled to plate members 110. The connecting means also include a plurality of fasteners 114, such as rivets or bolts, which extend through mounting holes 22 in horizontal member 20 and elongated slots 112 in plate members 110. As shown in FIG. 11, a gap "g" is formed between fastener 114 and each end portions 112A, 112B of elongated slots 112. Gap g provides for relative motion between horizontal member 20 and plate member 110.

Horizontal member 20, may be constructed from steel, reinforced concrete, composite materials, plastic, wood or the like. In addition, horizontal member 20 may comprise a number of structural shapes, such as I-shapes, T-shapes, angles, channels, flat plates, structural tubing or pipe and the like.

Figure 13:
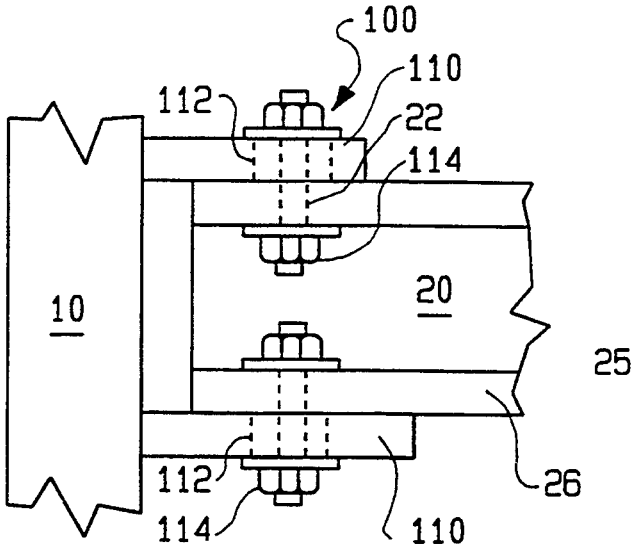
FIG. 13 is a cross-sectional view similar to FIG. 12 showing one alternate embodiment of the present invention.

FIG. 13 illustrates one alternative embodiment of the rigid frame having sequential connection 100 illustrated in FIGS. 11 and 12. In this embodiment, horizontal member 20 includes upper and lower flanges 24 and 26, respectively, and a web 25. Accordingly, mounting holes 22 may be formed through upper and lower flanges 24 and 26. Preferably upper and lower plate members 110 are provided at the upper end of vertical member 10 for connecting upper and lower flanges 24 and 26, respectively, to vertical member 10. Accordingly, upper and lower plate members 110 are rigidly secured to the upper end of member 10, and a plurality of fasteners 114 extend through elongated slots 112 in upper plate member 110 and mounting holes 22 in upper flange 24 of horizontal member 20. Similarly, a plurality of fasteners 114 extend through elongated slots 112 in lower plate member 110 and mounting holes 22 in lower flange 26 of horizontal member 20.

Figure 14:
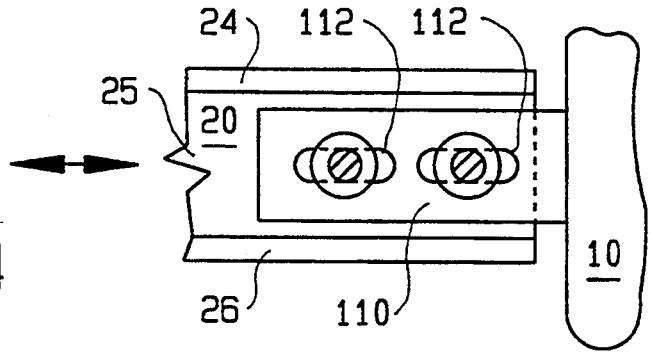
FIG. 14 is a cross-sectional view similar to FIG. 12 showing another alternate embodiment of the present invention.

Alternatively, as shown in FIG. 14, at least one plate member 110 is sequentially connected to web 25 of horizontal member 20. In this embodiment, mounting holes 22 are formed through web 25. Preferably, two plate members 110 having elongated slots 112 are provided. In this embodiment, one plate member 110 is sequentially connected to one side of web 25 and a second plate member 110 is sequentially connected to the other side of web 25.

As an alternative to embodiments described above, mounting holes 22 may be formed through plate member 110, while elongated slots 112 are formed through horizontal member 20.

Figure 15:
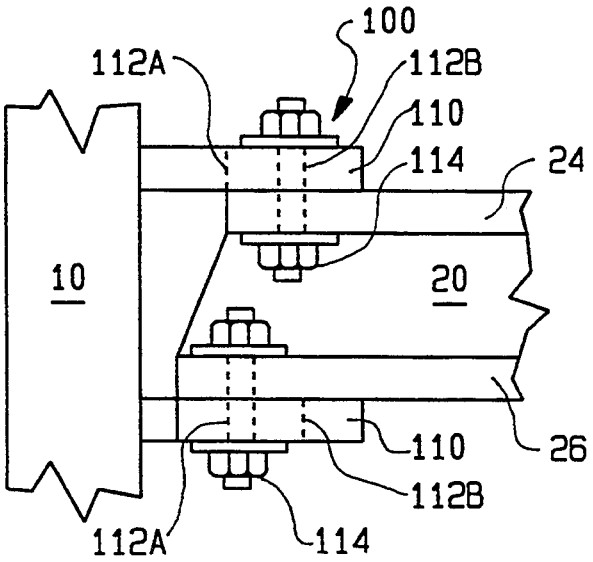
FIG. 15 is a cross-sectional view of the sequential connection of FIG. 13 showing selective rotation of one member.

Turning now to FIG. 15, there is illustrated a selective angular change (or rotation) between horizontal member 20 and vertical member 10 provided by sequential connection 100 of FIG. 13. In particular, horizontal member 20 undergoes a slight angular change when upper flange 24 and lower flange 26 move in opposite directions. As a result, fastener 114 through upper flange 24 and upper plate member 110 abuts a first end portion 112A of elongated slot 112 while fastener 114 through lower flange 26 and lower plate member 110 abuts a second end portion 112B of elongated slot 112.

Figure 16:
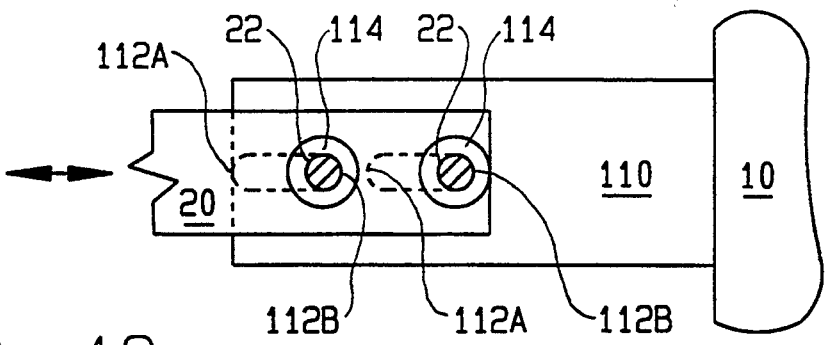
FIG. 16 is a plan view similar to FIG. 11 showing selective displacement of one sequentially connected member.

Turning now to FIG. 16 there is illustrated the selected substantially frictionless relative motion between horizontal member 20 and plate member 110 (as well as vertical member 10) provided by sequential connection 100. In particular, FIG. 16 illustrates a selective predetermined displacement, equal to gap g, of horizontal member 20 relative to plate member 110. Thus, as described in detail below, when a lateral load is applied to a structure having a planar frame 1 in which sequential connection 100 movably connects horizontal member 20 to a vertical member 10, horizontal member 20 rotates and/or displaces a predetermined amount relative to vertical member 10 before it carries load and/or moment. The advantages of a force resisting structure using sequential connections will be illustrated below in connection with FIGS. 28–41.

Figure 17:
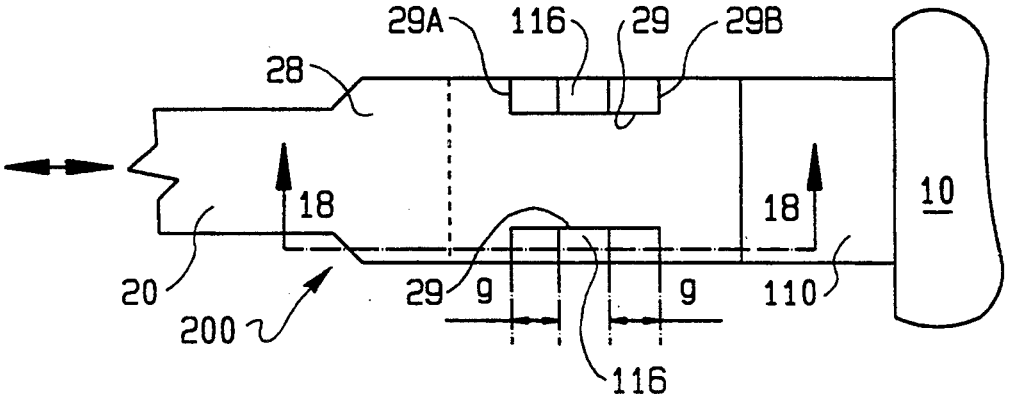
FIG. 17 is a plan view of an alternate embodiment of the sequential connection shown in FIGS. 11 and 12.
Figure 18:
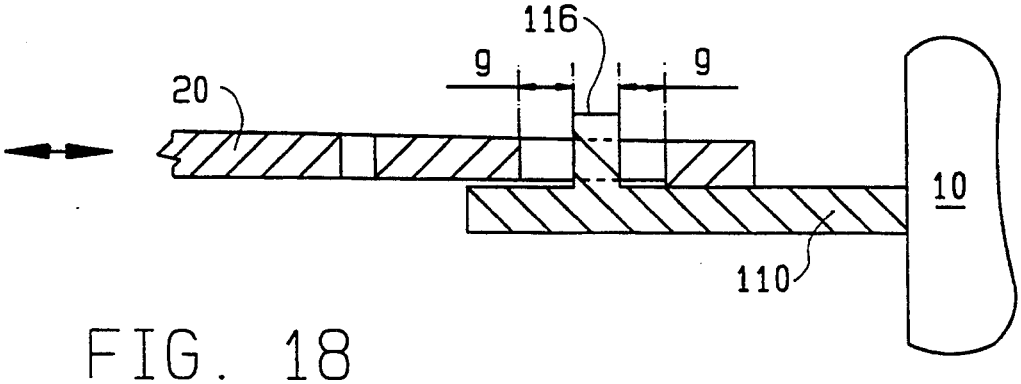
FIG. 18 is a cross-sectional view along line 18—18 of the sequential connection of FIG. 17.

FIGS. 17 and 18 illustrate another alternative embodiment 200 of sequential connection 100. In this embodiment, one end of horizontal member 20 is provided with a necked portion 28. Necked portion 28 includes at least one elongated opening 29 having end portions 29A and 29B. Plate 110 in this embodiment is provided with at least one protruding portion 116 which engages slot 29. A gap "g" for providing selective substantially frictionless relative motion between horizontal member 20 and plate 110 is provided between protruding portion 116 and end portions 29A, 29B of elongated slot 29. Accordingly, horizontal member 20 is free to rotate and/or displace a predetermined amount when a load is applied to a structure having sequential connection 200.

In a preferred embodiment, necked portion 28 includes a pair of elongated openings 29 which extend longitudinally along horizontal member 20. Elongated openings 29 may be positioned in a parallel arrangement as shown in FIG. 18, staggered or arranged consecutively along the length of neck portion 28. Also, in the preferred embodiment, elongated slots 29 are positioned along the longitudinal edges of necked portion 28. Significantly, the size and placement of protruding portions 116 of plate member 110 are coordinated with the size and placement of elongated slots 29 to ensure that protruding portions 116 engage elongated slots 29, so as to leave a gap g on either side of protruding portions 116.

Figure 19:
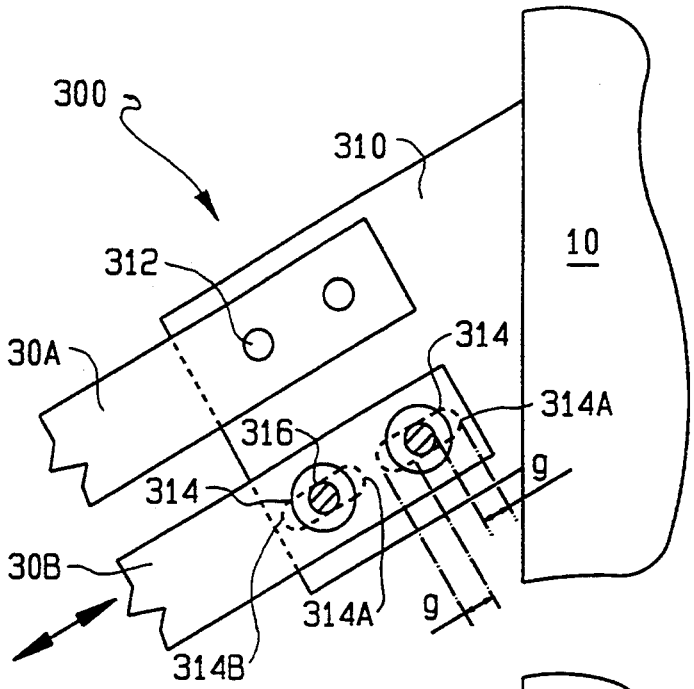
FIG. 19 is a front elevation view of an alternate embodiment of the present invention showing a sequentially connected bracing member.

FIG. 19 illustrates another preferred embodiment of the present invention, designated by the numeral 300, designed to improve the dynamic response of a braced frame, such as those described in connection with FIGS. 2–4, to lateral loads.

The lateral support system of FIG. 19 includes a diagonal member 30 which provides lateral support to frame 1. As shown in FIG. 19, diagonal member 30 preferably comprises a primary lateral bracing member 30A and a secondary lateral bracing member 30B. Primary and secondary lateral bracing members 30A, 30B are secured to the lower end of one vertical member 10 and the upper end of the second vertical member 10, as illustrated in FIG. 3.

Preferably, one end of secondary lateral bracing member 30B is sequentially connected to a vertical member 10. Illustratively, FIG. 19 shows the upper end of secondary lateral bracing member 30B sequentially connected to the upper end of vertical member 10. In this embodiment, sequential connection 300 comprises a plate member 310 for securing primary and secondary lateral bracing members 30A, 30B to the upper end of vertical member 10. Plate member 310 may be provided with mounting holes 312 for firmly securing primary lateral member 30A thereto. Plate member 310 also includes a plurality of elongated slots 314, having end portions 314A and 314B. Elongated slots 314 preferably extend axially along the longitudinal axis 315 of secondary lateral bracing member 30B. Mounting holes 36 are provided in the end of secondary lateral bracing member 30B which is sequentially connected to plate member 310. Mounting holes 36 align with elongated slots 314 of plate member 310 when secondary lateral bracing member 30B is sequentially connected thereto.

Sequential connection 300 further includes a plurality of fasteners 316 which extend through mounting holes 36 of secondary lateral bracing member 30B and elongated slots 314 of plate member 310. As described above in connection with FIGS. 11 and 16, a gap g is provided between fastener 316 and end portions 314A, 314B of elongated slot 314. Gap g provides for selective predetermined substantially frictionless relative motion between secondary lateral bracing member 30B and plate member 310 when a lateral load is applied to a structure having a sequential connection 300. As a result, when a lateral load is applied to the structure, primary lateral bracing member 30A carries the entire load in either tension or compression as previously described, until member 30A undergoes a deformation (either elongating or shortening, accordingly) equal to gap g. At that point, fastener 316 will abut either end portion 314A or 314B of elongated slots 314 in plate member 310, causing secondary lateral bracing member 30B to carry load (i.e., become active).

As previously described in connection with FIGS. 11–18, secondary lateral bracing member may comprise any number of a wide variety of shapes and materials. Also, elongated slots 314 may be formed in secondary lateral bracing member 30B while mounting holes 36 are formed in plate member 310.

Figure 20:
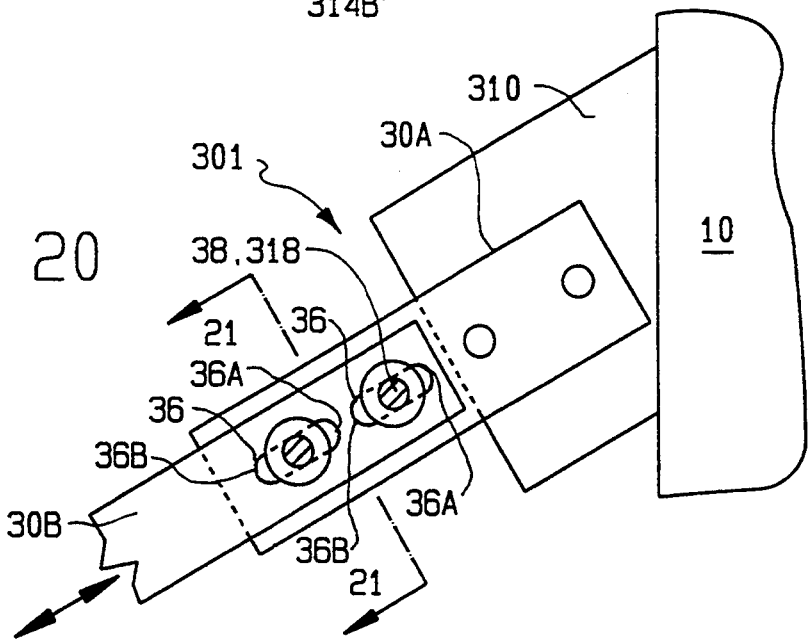
FIG. 20 is a front elevation view of an alternate embodiment of the sequential connection shown in FIG. 19.
Figure 21:
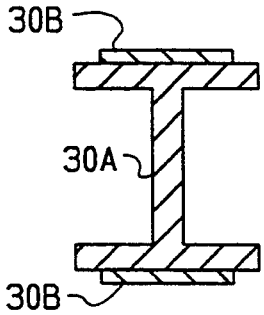
FIG. 21 is a cross-sectional view along line 21—21 of the sequential connection of FIG. 20.
Figure 22:
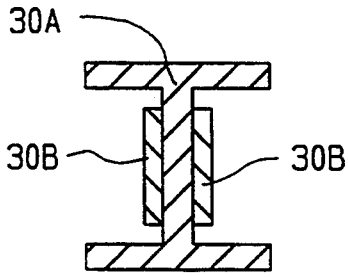
FIG. 22 is an alternate embodiment of the sequential connection shown in FIG. 21.

FIGS. 20–22 illustrate an alternative embodiment 301 of sequential connection 300. As shown in FIG. 20, diagonal member 30 again preferably comprises a primary lateral bracing member 30A, such as a plate or I-section, and at least one secondary lateral bracing member 30B. Primary lateral bracing member 30A is secured to the lower end of one vertical member 10 and the upper end of the second vertical member 10, as illustrated in FIG. 3. Secondary lateral bracing member 30B is sequentially connected, in this illustration, at its upper end to primary lateral bracing member 30A.

Sequential connection 301 also includes means for movably connecting at least one secondary bracing member 30B to primary bracing member 30A so as to provide selective substantially frictionless longitudinal motion of secondary lateral bracing member 30B relative to primary lateral bracing member 30A, and means for resisting relative motion once the selective longitudinal motion has taken place.

As shown in FIG. 21, primary lateral bracing member 30A preferably comprises a section, such as a channel or I-section, having upper and lower flanges and a web. A plurality of mounting holes 38 are provided at a predetermined distance from one end portion of primary lateral bracing member 30A, for receiving fasteners 318, which sequentially connect secondary lateral bracing member 30B thereto. Mounting holes 38 may be provided in the web or, preferably, in the upper and lower flanges of primary lateral bracing member 30A.

In this embodiment, the means for movably connecting at least one secondary lateral bracing member 30B to primary lateral bracing member 30A further comprises a plurality of elongated slots 36 provided through one end of secondary lateral bracing member 30B. The other end of secondary lateral bracing member 30B is preferably securely fixed to primary lateral bracing member 30A by standard bolted connections, welds, adhesives, or the like.

Slots 36 preferably extend axially along the longitudinal axis 315 of secondary lateral bracing member 30B and align with mounting holes 38 in primary lateral bracing member 30A. A plurality of fasteners 318 extend through mounting holes 38 in primary lateral bracing member 30A and elongated slots 36 in secondary lateral bracing member 30B. As described above in connection with FIG. 16, a gap g is provided between fasteners 318 and send portions 36A and 36B of elongated slots 36. Gap g provides for substantially frictionless relative movement between primary lateral bracing member 30A and secondary lateral bracing member 30B as will be described below.

As is readily apparent, secondary lateral bracing member 30B is movable in a longitudinal direction relative to primary lateral bracing member 30A when a lateral load is applied to a structure having a sequential connection 301. In particular, secondary lateral bracing member 30B is movable relative to primary lateral bracing member 30A from a first position in which fasteners 318 are located a predetermined distance g from end portions 36A and 36B of elongated slots 36, to a second position in which fasteners 318 abut either end portion 36A or 36B of slot 36, depending on the direction of the applied force. This movement is similar to the movement illustrated in FIG. 16, and is similarly without significant friction between moving parts.

Significantly, when a lateral load is applied to a frame having a secondary lateral bracing member 30B which is connected to a primary lateral bracing member 30A by sequential connection 301, primary lateral bracing member 30A deforms axially, either by elongating or shortening depending upon the direction of the load, while secondary lateral bracing member 30B moves relative to primary lateral bracing member 30A without carrying load. Accordingly, primary lateral bracing member 30A carries the total lateral load applied to the frame until secondary lateral bracing member 30B moves to the second position. As described above, at this second position, fasteners 318 abut end portions 36A or 36B and thus secondary lateral bracing member begins to carry load, which is transferred to it by fasteners 318. At this position, secondary lateral bracing member 30B is considered "active".

In an alternative embodiment illustrated in FIG. 22, mounting holes 38 are formed through the web of primary lateral bracing member 30A and at least one secondary lateral bracing member 30B having elongated slots 36 is sequentially connected thereto. Preferably, a pair of secondary lateral bracing members 30B are used, whereby one secondary lateral bracing member 30B is sequentially connected to one side of the web and a second secondary lateral bracing member 30B is sequentially connected to the other side of the web.

Figure 23:
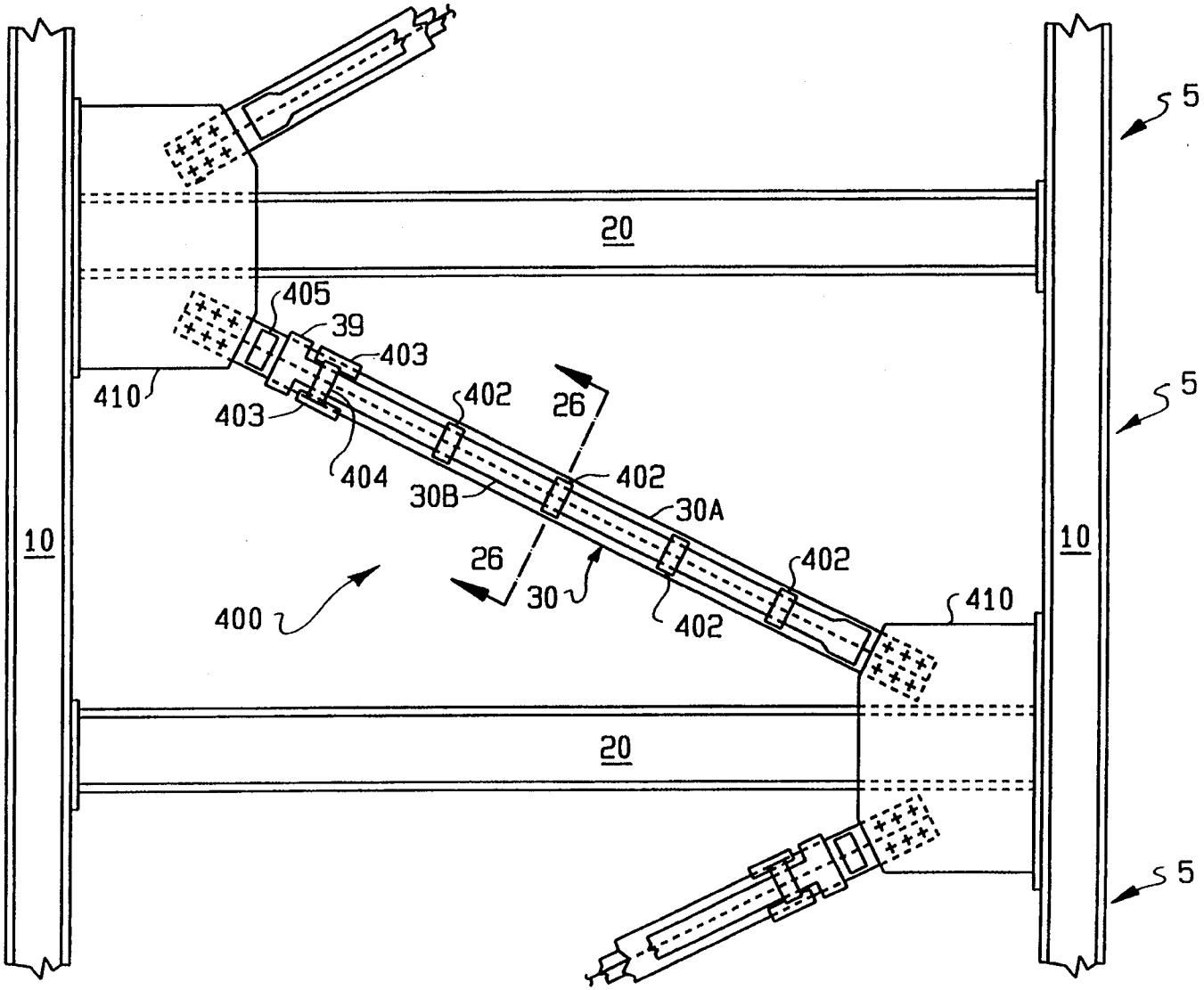
FIG. 23 is a front elevation view of another embodiment of the present invention showing a sequentially connected bracing member.

Another alternative embodiment is shown in FIGS. 23–26. In particular FIG. 23 illustrates a multistory structure having a plurality of frames 5. Each frame 5 comprises a pair of vertical members 10 and a horizontal member 20 which extends from one vertical member 10 to the second vertical member 10. Frame 5 also includes a diagonal member 30 which extends from a lower portion of the second vertical member 10 to an upper portion of the first vertical member 10. Diagonal member 30 provides lateral support to frame 5.

Preferably, diagonal member 30 comprises a primary lateral bracing member 30A which is secured to a gusset plate 410 at each end, and at least one secondary lateral bracing member 30B. In the embodiment shown in FIGS. 25 and 26, primary lateral bracing member comprises an I-section. Alternatively, member 30A may comprise a variety of shaped sections or may comprise a flat plate.

Secondary lateral bracing member 30B is movably connected to primary lateral bracing member 30A by sequential connection 400. Illustratively, secondary lateral bracing member 30B comprises a flat plate. As is apparent, however, other structural shapes may be used.

Figure 26:
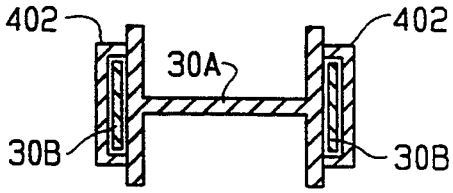
FIG. 26 is a cross-sectional view along line 26—26 of FIG. 23.

Sequential connection 400 comprises a plurality of C-shaped straps 402, a pair of guide plates 403, a flat strap 404 and a stop 405. As illustrated in FIG. 26, C-shaped straps 402 each enclose a portion of secondary lateral bracing member 30B, which are shown as a pair of plates movably connected to the upper and lower flanges, respectively, of primary lateral bracing member 30A. Alternatively, secondary lateral bracing member 30B may comprise a pair of plates which are sequentially connected to the web of primary lateral bracing member 30A as shown in FIG. 22. C-shaped straps 402, which may comprise steel, plastic, aluminum and the like, are secured to the upper and lower flanges of primary lateral bracing members 30A.

Figure 24:
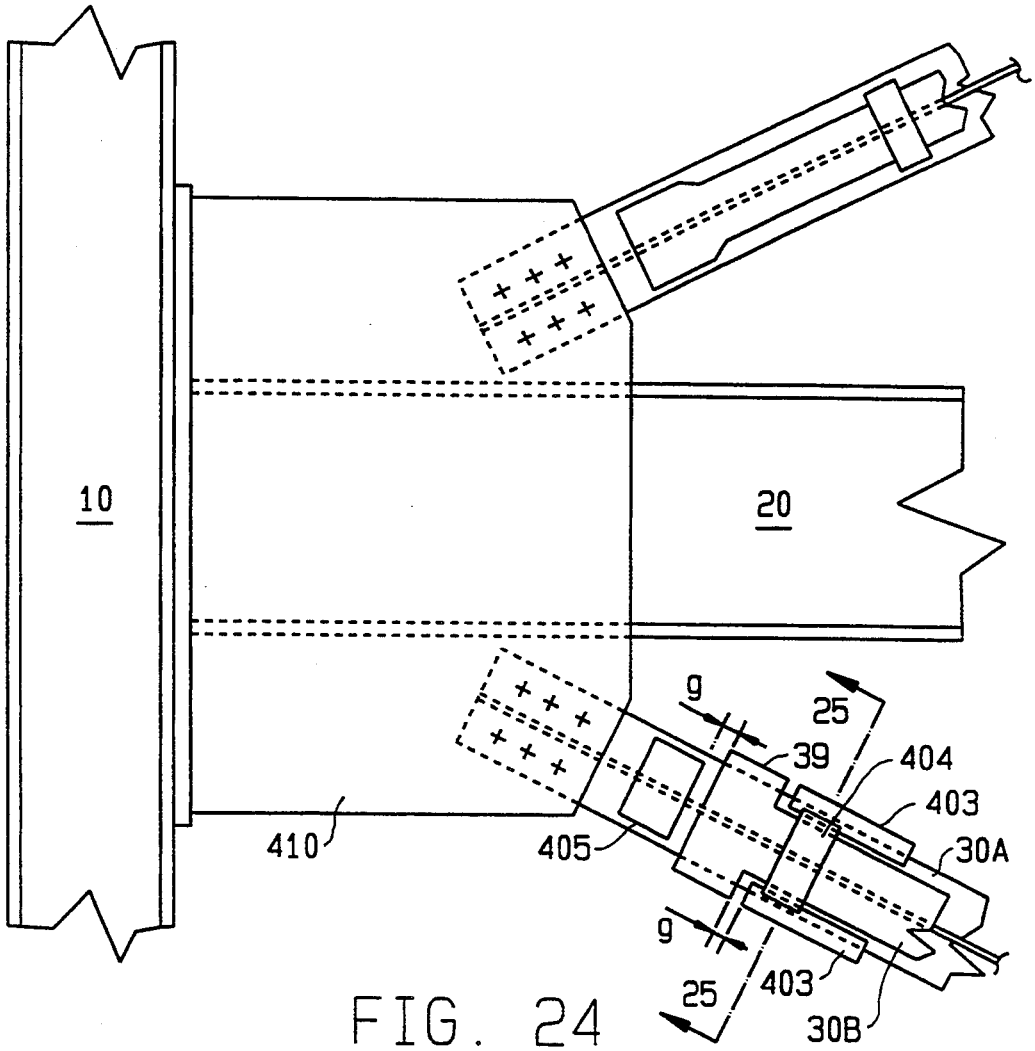
FIG. 24 is an enlarged front elevation view of the embodiment shown in FIG. 23.
Figure 25:
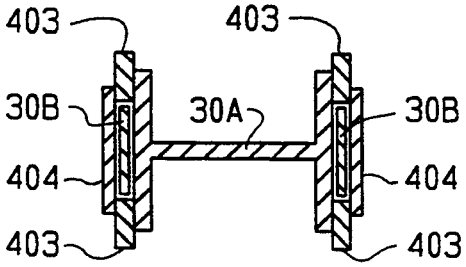
FIG. 25 is a cross-sectional view along line 25—25 of FIG. 24.

As shown in FIG. 24, at one end of secondary lateral bracing member 30B, a pair of guide plates 403 are secured to primary lateral bracing member 30A, on either longitudinal side of secondary lateral bracing member 30B. As shown in FIG. 25, guide plates 403 have a thickness that is slightly greater than the thickness of secondary lateral bracing member 30B. Flat strap 404 extends from one guide plate 403 to the second guide plate 403, thereby enclosing a portion of secondary lateral bracing member 30B. Secondary lateral bracing member 30B is provided at one end with a necked portion 39 which is positioned a predetermined distance away from guide plates 403. This predetermined distance forms a gap g.

As is best seen in FIG. 24, stop 405 is secured to primary lateral bracing member 30A by adhesive, welding, fastening or the like, at a predetermined distance from one end of secondary lateral bracing member 30B when member 30B is movably connected thereto. The predetermined distance also defines a gap g which corresponds to substantially frictionless selective axial movement of secondary lateral bracing member 30B relative to primary lateral bracing member 30A.

Accordingly, secondary lateral bracing member 30B is movably connected to primary lateral bracing member 30A. When a lateral force is applied to the multistory structure, primary lateral bracing member 30A carries the entire load, causing member 30A to elongate or shorten accordingly. Secondary lateral bracing member 30B, on the other hand, does not carry load initially. Instead, secondary lateral bracing member 30B moves relative to primary lateral bracing member 30A and is guided by C-shaped straps 402 and guide plates 403. Once secondary lateral bracing member 30B moves a distance g in either longitudinal direction, necked portion 39 of secondary lateral bracing member 30B will abut either stop 405 or guide plates 403 which thereafter limits relative movement of secondary lateral bracing member 30B. Thereafter, secondary lateral bracing member 30B carries the lateral load applied to frame 5 along with primary lateral bracing member 30A.

As will be readily apparent from the above description to one of ordinary skill in the art, the embodiments described above in connection with a single braced frame are also applicable to X-braced frames wherein one end of each X-brace is sequentially connected by any of the previously disclosed sequential connections.

Another embodiment of the present invention (not shown) involves sequentially connecting structural X-bracing cables to vertical members 10. In this embodiment, one end of each X-braced cable may be connected to a vertical member 10 using a connecting member which provides a predetermined substantially frictionless relative motion between the cable and vertical member 10 in response to a lateral load. Accordingly, X-bracing cables which are sequentially connected to a vertical member 10 will not carry load (via tension) until the predetermined relative motion has occurred.

Figure 27:
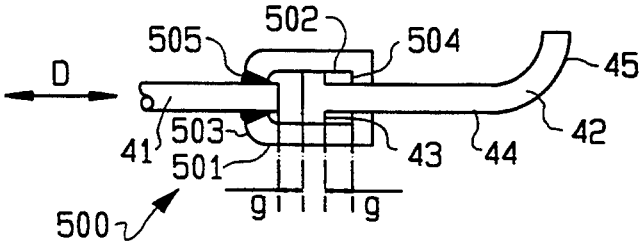
FIG. 27 is a cross-sectional view of a sequential connection for reinforced concrete structures.

FIG. 27 illustrates another embodiment of the present invention. In this embodiment, sequential connection 500 is illustrated for use in a structure comprising reinforced concrete members, such as a rigid frame 2 shown in FIG. 5 or shear wall 40 shown in FIG. 6.

In one such embodiment, the structural member sequentially connected according to my invention comprises a plurality of reinforcing bars which extend from one vertical member 10 to the second vertical member 10. To ensure structural continuity, anchor members are provided which tie the sequentially connected member to an adjacent vertical member 10. Alternatively, anchor members are provided in a reinforced concrete member so as to provide substantially frictionless selective predetermined relative motion between adjoining reinforcing members.

Sequential connection 500 comprises means for movably connecting a second end of a reinforcing bar 41 with a first end of an adjacent anchor member 42. Preferably, the connecting means comprise a sleeve 501 having an inner cavity 502. Cavity 502 further includes a first end 503 for receiving the second end of reinforcing bar 41 and a second end 504 for receiving the first end of anchor member 42. Preferably the second end of reinforcing bar 41 is secured to sleeve 501 by any suitable means, such as welding, adhesive and the like. In the preferred embodiment, the second end of reinforcing bar 41 is welded to sleeve 501 by weld 505.

In the preferred embodiment, anchor member 42 is preferably provided with a bar-like body 44 having a head portion 43 which is positioned inside cavity 502 of sleeve 501, and a tail portion 45. Tail portion 45 may be connected to vertical member 10. Head portion 43 is slightly smaller than the inner dimensions of cavity 502 so that head portion 43 can move freely therewithin. Preferably, when a reinforced concrete member is provided with a sequential connection 500, head portion 43 is positioned a predetermined distance g from both the second end of reinforcing bar 41 and second end 504 of cavity 502. As such, anchor member 42 is freely movable relative to reinforcing bar 41, in the direction marked by arrow D a distance g in either direction. Accordingly, when a lateral load is applied to a structure having a reinforced concrete member sequentially connected by sequential connection 500, reinforcing bar 41 carries the entire load until reinforcing bar 41 deforms a distance g. Thereafter, head portion 43 of anchor member 42 will abut either the second end of reinforcing bar 41 or second end 504 of sleeve 501. At this point, anchor member 42 carries load along with reinforcing bar 41.

As is readily apparent to one of ordinary skill in the art, any of the above-described sequential connections or combination of sequential connections may be used in designing a lateral support structure for a structure subject to dynamic lateral loads. For example, in a multistory structure having a plurality of bays, it is possible to provide lateral support to some bays by sequentially connecting certain predetermined horizontal members 20 to certain vertical members 10 by sequential connections 100, 200 or 500. Meanwhile, other bays may be diagonally or X-braced using sequential connections, such as connections 300, 301 or 400.

Figure 28:
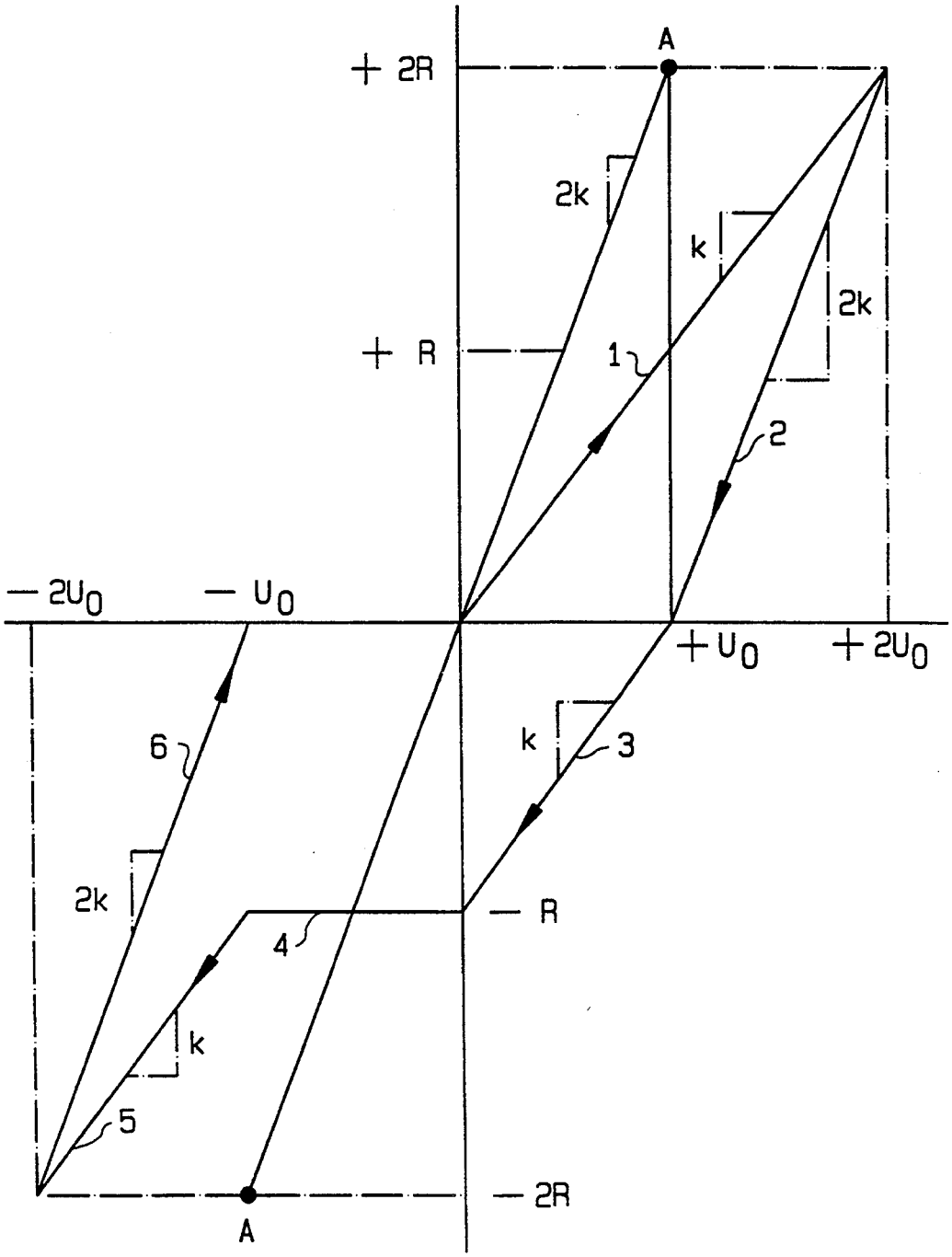
FIG. 28 is a graph of the load resistance path of a lateral support system having sequentially connected members in accordance with the present invention.

FIG. 28 is a graphical representation of a single loading/unloading cycle of amplitude ±2 R. This graph compares the response of two equivalent structural systems having a lateral support system comprising a standard diagonally braced frame, such as those illustrated in FIGS. 3, 7 and 9. In the first system (hereinafter called System 1) diagonal member 30 comprises a primary lateral bracing member 30A and a secondary lateral bracing member 30B, each having a stiffness k, which are connected using standard connections. Accordingly, System 1 has a total stiffness of 2 k. In the second system (hereinafter System 2), also comprising a primary lateral bracing member 30A and a secondary lateral bracing member 30B each having a stiffness k, each secondary lateral bracing member 30B is sequentially connected using sequential connection 300 of FIG. 19. In both systems, the primary and secondary lateral bracing members have a yield resistance R.

Dashed line A—A represents the elastic load resistance path of amplitude ±2 R of System 1. The solid lines illustrate the complex load resistance path of System 2, which uses a sequential connection. In particular, this load resistance path includes several segments, described below in which the numbered paragraphs corresponds to the numbers on the graph.

(1) linear elastic response occurs in primary lateral bracing member 30A for stress levels below the yield resistance R of member 30A. When the stress level is equal to or more than R, primary lateral bracing member 30A deforms (either elongating or shortening), thereby causing the system to absorb energy. At a predetermined point of deformation, $u_0(=g)$, fastener 316 will abut end portion 314A of elongated slot 314 thereby causing secondary lateral bracing member 30B to carry load (i.e., become active). The system then carries load, at a stiffness k, to +2 R with the system undergoing a total deformation of 2 $u_0$.

(2) Since secondary lateral bracing member 30B is active, it acts together with primary lateral bracing member 30A during unloading. Thus, the system unloads at a stiffness 2 k. In addition, because of deformation $u_0$ in primary lateral bracing member 30A, the systems stores energy during unloading.

(3) As the unloading cycle continues, fastener 316 moves away from a position abutting end portion 314A of elongated slot 314, again forming a gap. Thus, secondary lateral bracing member 30B becomes inactive. Therefore, unloading continues at a stiffness k, provided only by primary lateral bracing member 30A.

(4) Because of deformation $u_0$ in primary lateral bracing member 30A, the system experience a low amplitude (−R) yield plateau in which lateral bracing member 30A undergoes a second deformation $-u_0$ which is in the opposite direction of the initial deformation. Energy dissipation is enhanced by the presence of this low amplitude yield plateau, which is similar to the well-known Bauschinger effect. In addition, the low amplitude yield plateau reduces residual permanent deformation in the system under dynamic excitation.

(5) Since primary lateral bracing member 30A has undergone deformation $-u_0$, fastener 316 now abuts end portion 314B of elongated slot 314. The System then carries load, at stiffness k, to −2 R with the System undergoing a total deformation of −2 $u_0$.

(6) as in segment (2), primary lateral bracing member 30A and secondary lateral bracing member 30B act together during unloading to provide a stiffness 2 k. The System again absorbs energy during unloading due to the deformation $-u_0$ in primary lateral bracing member 30A.

As can be seen from FIG. 28, the reduced loading stiffness, indicated by (1) above, which results from the sequential connection of secondary lateral bracing member 30B, implies a lower frequency of the sequentially connected system.

Figure 29:
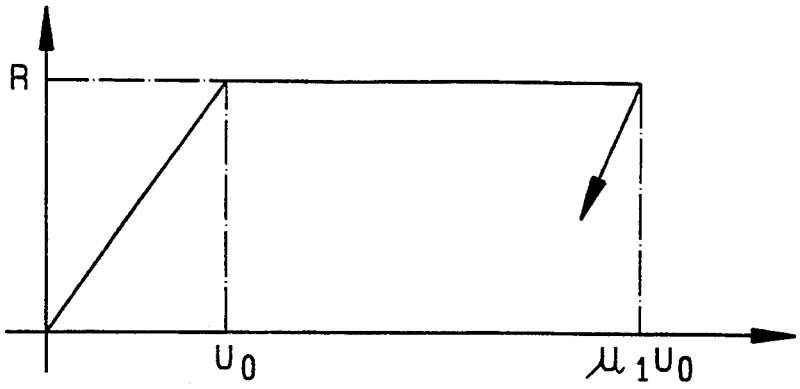
FIG. 29 is a graph of the load resistance path of a support system having standard connections.
Figure 30:
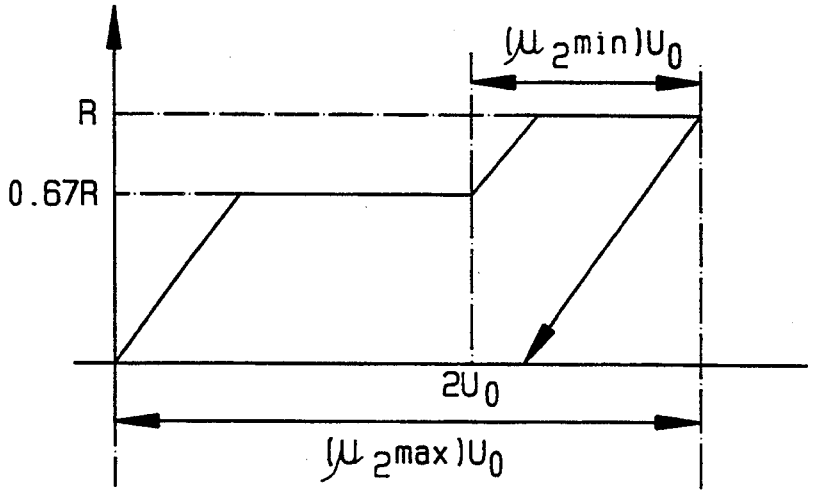
FIG. 30 is a graph of the load resistance path of a support system having sequential connections.

To highlight the dramatic improvement to a structure's dynamic response, the following comparison of System 1 and System 2 is also provided. The load resistance path for System 1 is illustrated in FIG. 29, while the load resistance path for System 2 is illustrated in FIG. 30.

In this illustration, diagonal member 30 of both systems is constructed of a material having a standard elasto-plastic manner and a yield resistance R. Accordingly, diagonal member 30 comprises a primary lateral bracing member 30A and a secondary lateral bracing member 30B such that $R=R_A+R_B$, where $R_A$ equals the yield resistance of primary lateral bracing member 30A and $R_B$ equals the yield resistance of secondary lateral bracing member 30B.

Figure 40:
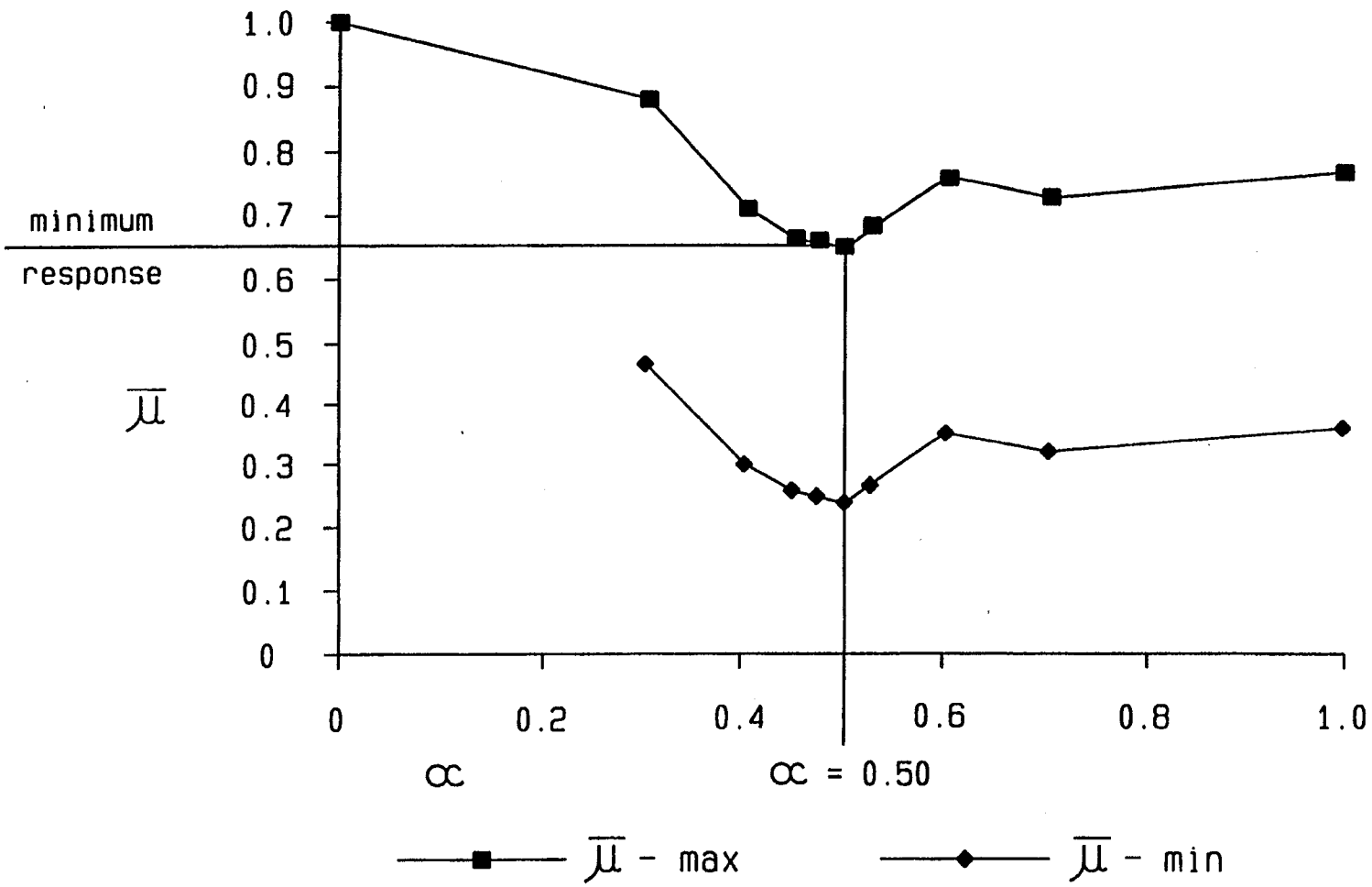
FIG. 40 is a parametric optimization of the ratio of strengths required to resist seismic excitation, using sequential connections according to my invention.

FIG. 40 represents a parametric optimization of the ratio $\alpha$ of material used in lateral bracing members 30A and 30B to resist the loading. In an optimum solution (i.e., where the response of the System is at a minimum) where secondary lateral bracing member 30B of System 2 is provided with elongated slots 314 such that $g=2\ u_0$, $\alpha=0.50$. Accordingly, the resulting yield resistances of the lateral bracing members will be $R_A=0.67$ R and $R_B=0.33$ R, respectively.

Accordingly, diagonal member 30 of both System 1 and System 2 have a total equivalent yield resistance R, so that displacement at yield $u_0$ is identical. In System 1, however, yielding occurs simultaneously in both diagonal bracing members and has a value $\mu_1$. In System 2, on the other hand, yielding occurs in primary lateral bracing member 30A only, until secondary lateral bracing member 30B becomes active. As a result, System 2 will have maximum and minimum values of ductility, as illustrated in FIG. 30.

The response of these two systems can be evaluated by the ratios $$\mu_{max}=\mu_{2max}/\mu_1$$

$$\mu_{min}=\mu_{2min}/\mu_1$$

where $\mu_{2max}$ and $\mu_{2min}$ are defined in FIGS. 29 and 30. The responses may also be evaluated by the ratio of average residual permanent deformation $\mu_p$, where $$\mu_{1p}=\mu_{1p}/\mu_{2p}$$

and where $\mu_{1p}$ and $\mu_{2p}$ are the ductilities of the average permanent deformations of the two systems at the end of a seismic excitation.

Figure 31:
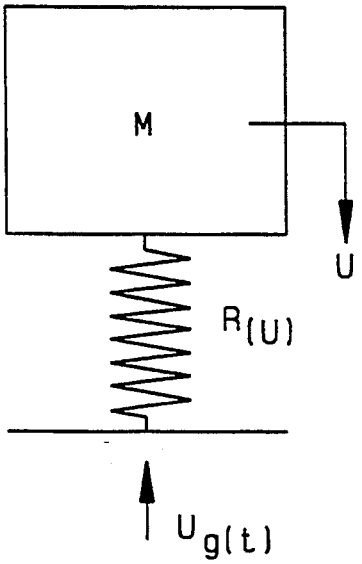
FIG. 31 is a front elevation view of a single degree of freedom mass-resistance model of a support system having standard connections.
Figure 32:
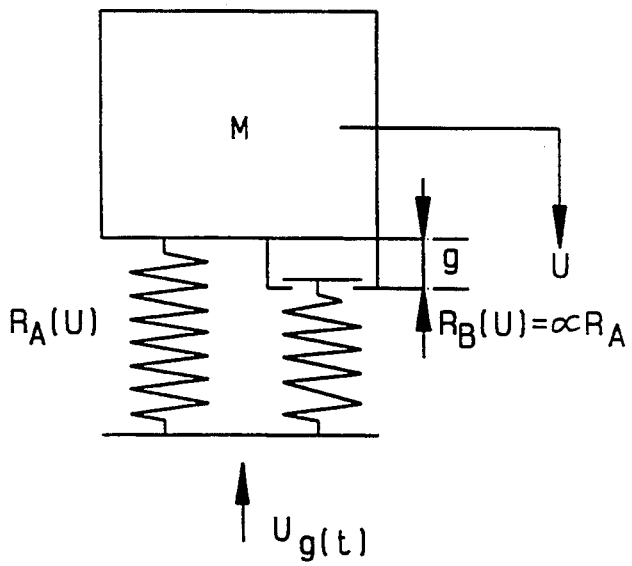
FIG. 32 is a front elevation view of a single degree of freedom mass-resistance model of a support system having sequential connections.
Figure 33:
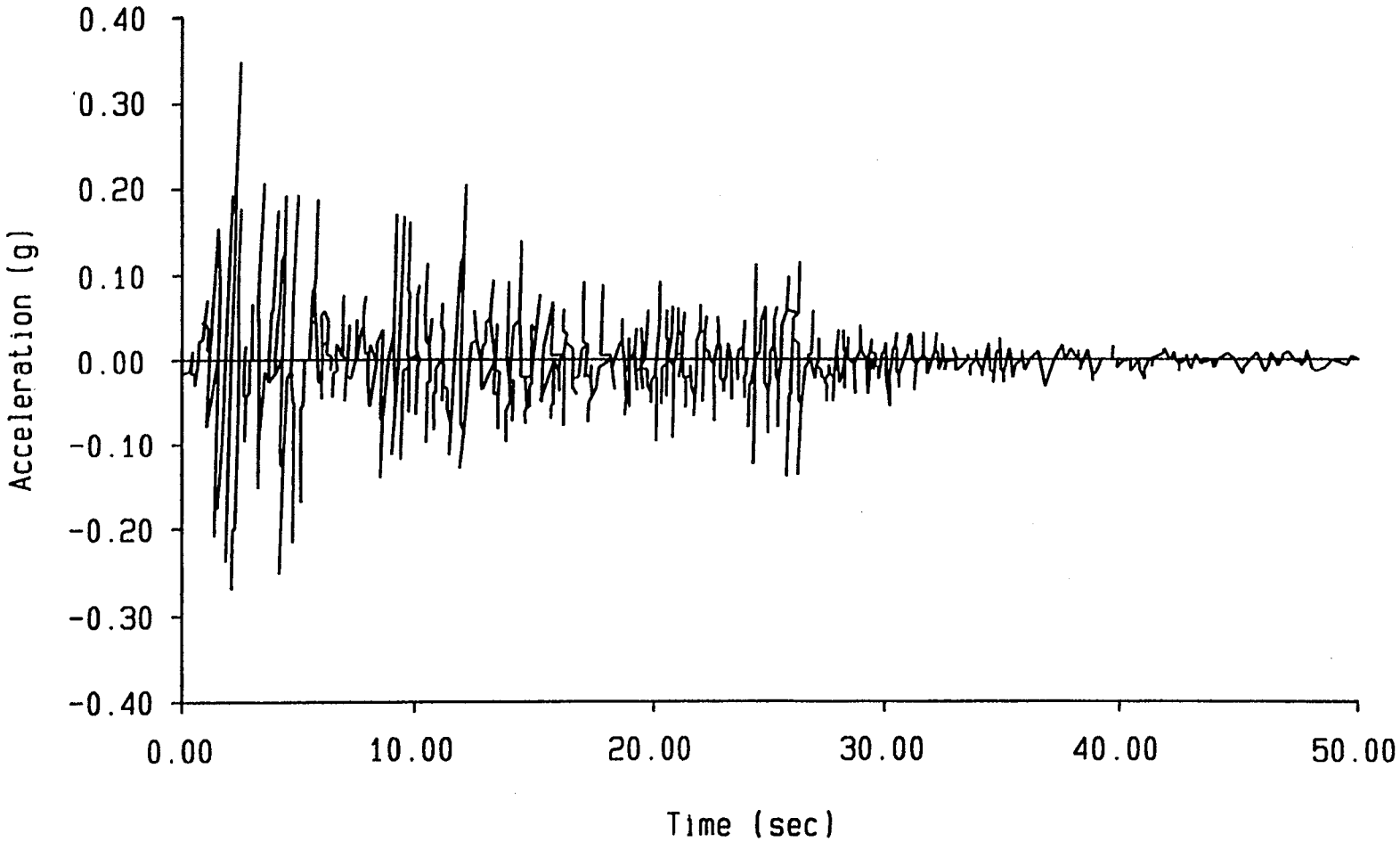
FIG. 33 is an N-S graph of the 1940 El Centro earthquake.

Using the single degree of freedom mass-resistance models shown in FIGS. 31 and 32 for Systems 1 and 2, respectively, the Systems can be evaluated. Assuming a fundamental period of the systems $$T=0.64 \text{ seconds}$$

which is typical value for a seven-story building, and the following values

TABLE 1[1]

| System 1 | System 2 |
|---|---|
| $R = R_A + R_B = 62_k$ | $R_A = 41.3^k$ |
| | $R_B = 20.7^k$ |
| $u_o = 1.30$ in. | $u_o = 1.3$ in. |
| $m = 0.84$ ksec$^2$/inc. | $m = 0.84$ ksec$^2$/in. |
| | $g = 2.6$ in. |

[1]The equivalent mass of the system is assumed to be 0.12 sec$^2$/in/floor. The resistance R is taken at twice that of the design base shear force (Uniform Building Code-90).

If both systems are subjected to an acceleration time history of 50 second duration, corresponding to the N-S component of the 1940 El Centro earthquake (FIG. 33), the following seismic response of the Systems, in terms of ductility, are given below:

TABLE 2

| System 1 | System 2 | Ratio: System 1 / System 2 |
|---|---|---|
| $\mu_{1max} = 4.88$ | $\mu_{1max} = 3.17$ | $\mu_{max} = 0.65$ |
| | $\mu_{2min} = 1.17$ | $\mu_{min} = 0.24$ |
| $\mu_{p1} = 1.55$ | $\mu_{p2} = 0.26$ | $\mu_p = 0.17$ |

Figure 34:
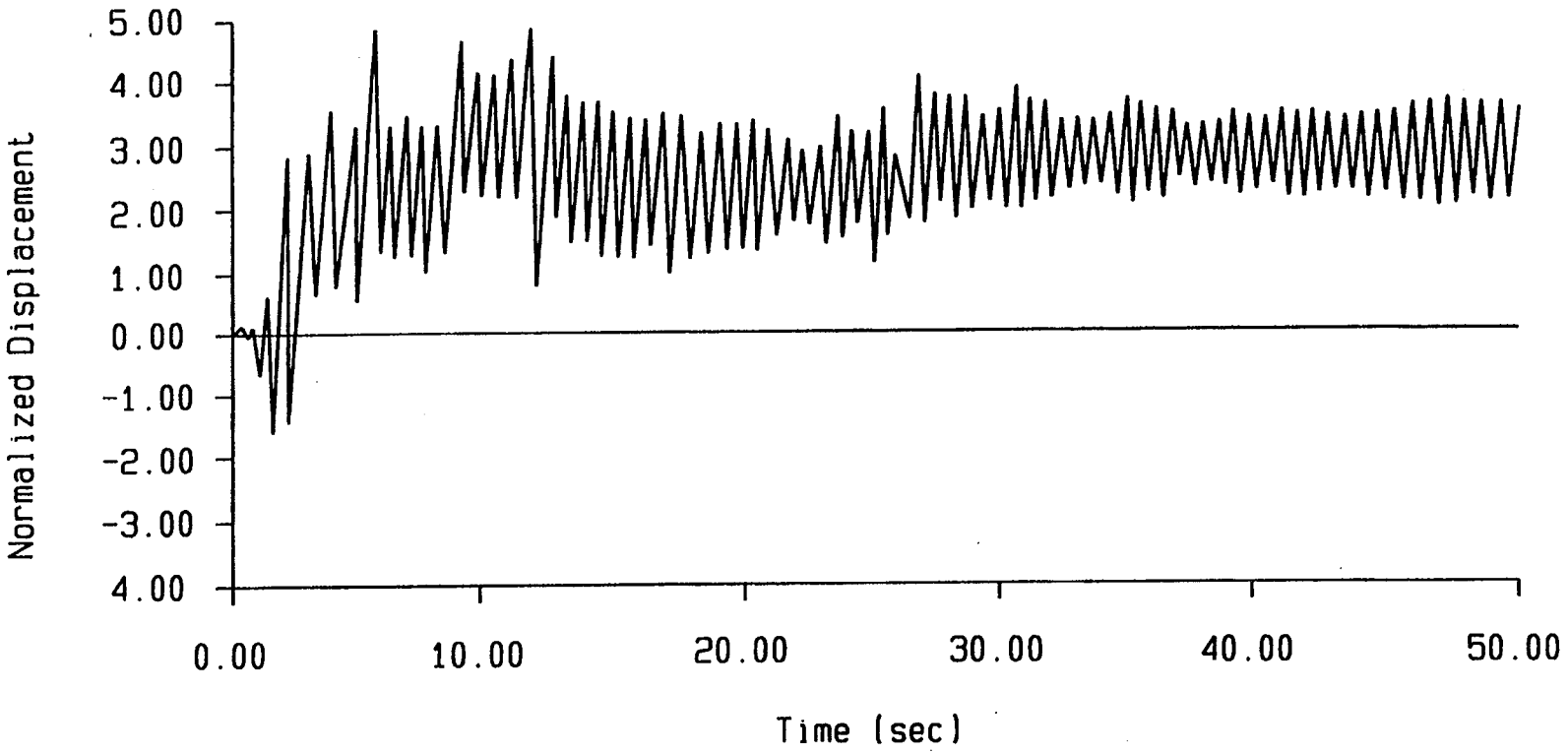
FIG. 34 is a graph of the displacement-time history of the mass-resistance model of FIG. 31.
Figure 35:
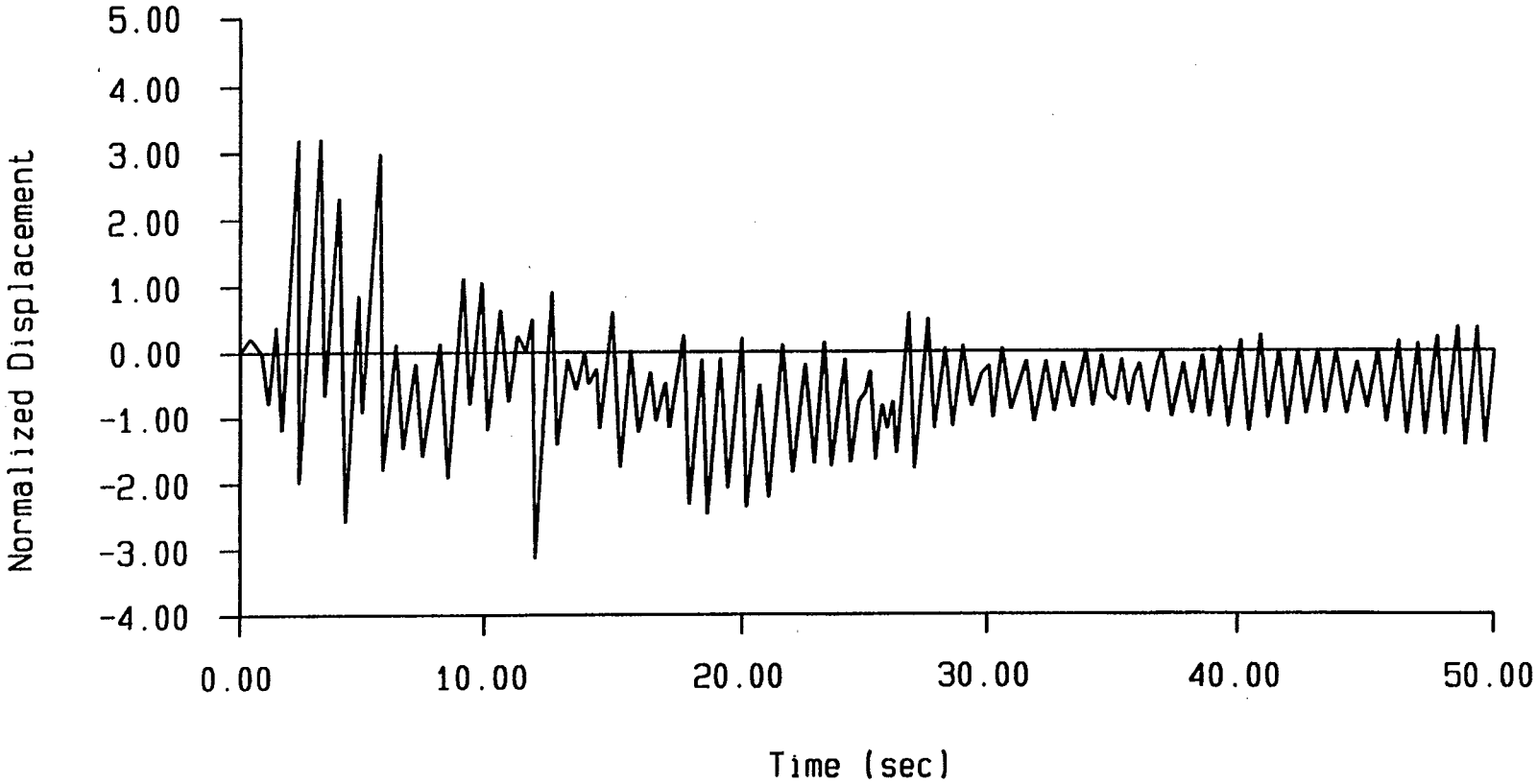
FIG. 35 is a graph of the displacement-time history of the mass resistance model of FIG. 32.
Figure 36:
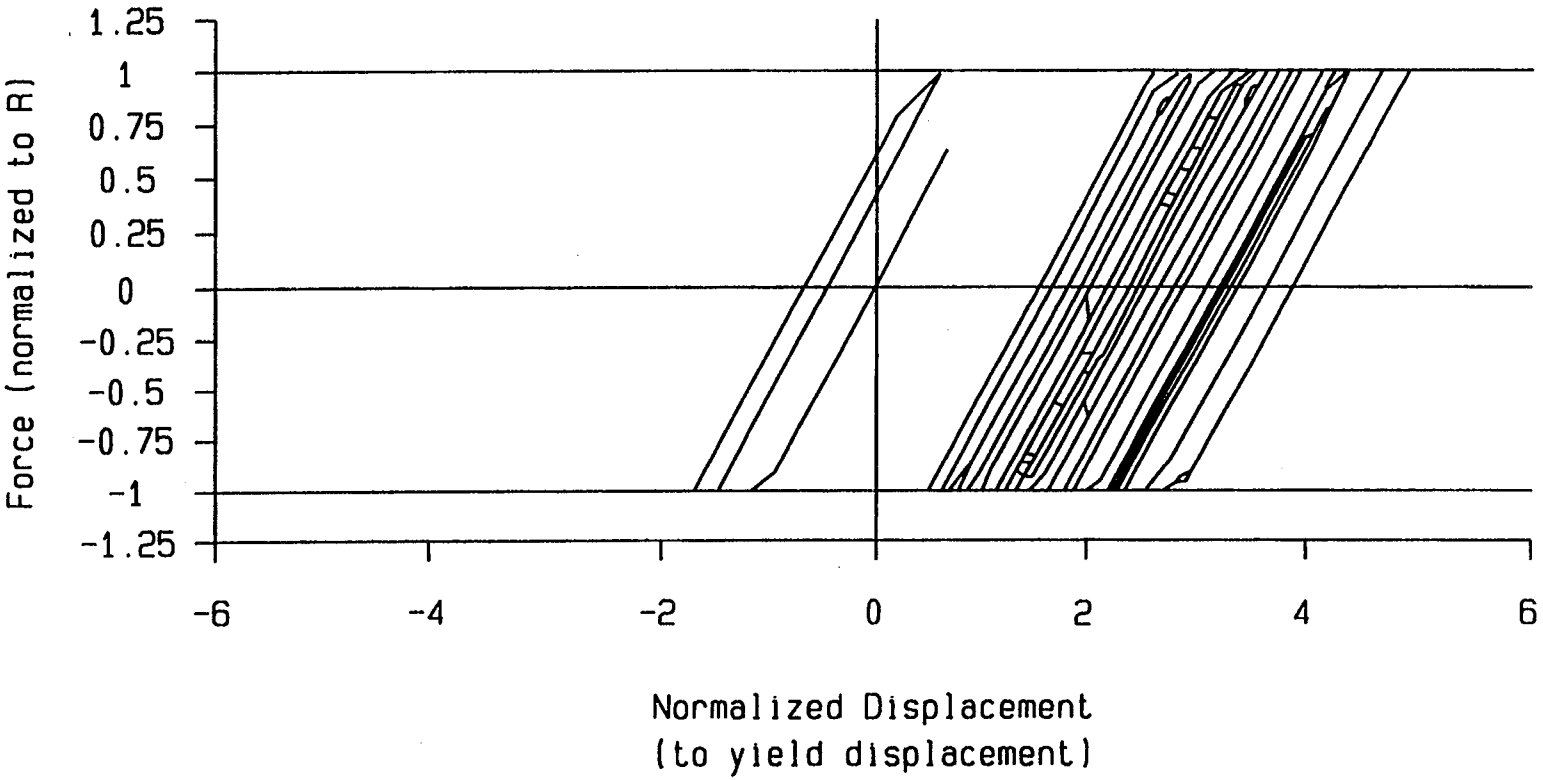
FIG. 36 is a graph showing the load resistance path of the mass-resistance model of FIG. 31.
Figure 37:
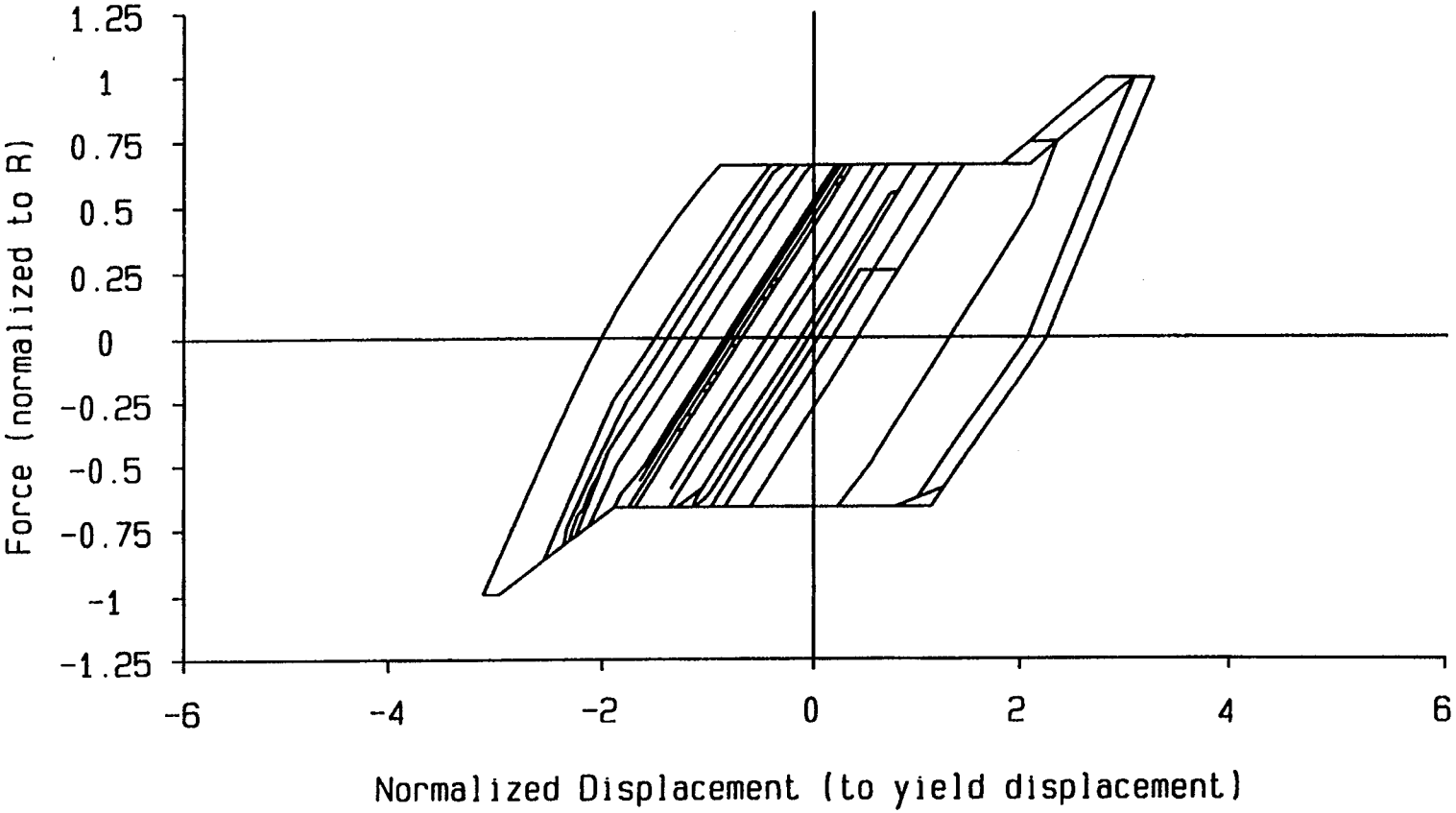
FIG. 37 is a graph showing the load resistance path of the mass-resistance model of FIG. 32.

The resulting displacement time histories of the systems are given in FIGS. 34 and 35, respectively.

As can be seen from Table 2, the peak response of System 2 is significantly lower. The reason for the decrease of the peak response of System 2 is clarified by examining the load resistance path of the two systems. In the sequentially connected System 2, the initial phase of the excitation induces a higher energy dissipation, followed by excursions around the second lower yield plateau. This results in a continuous decrease of the amplitude of the displacement response time history, shown in FIG. 35.

Figure 38:
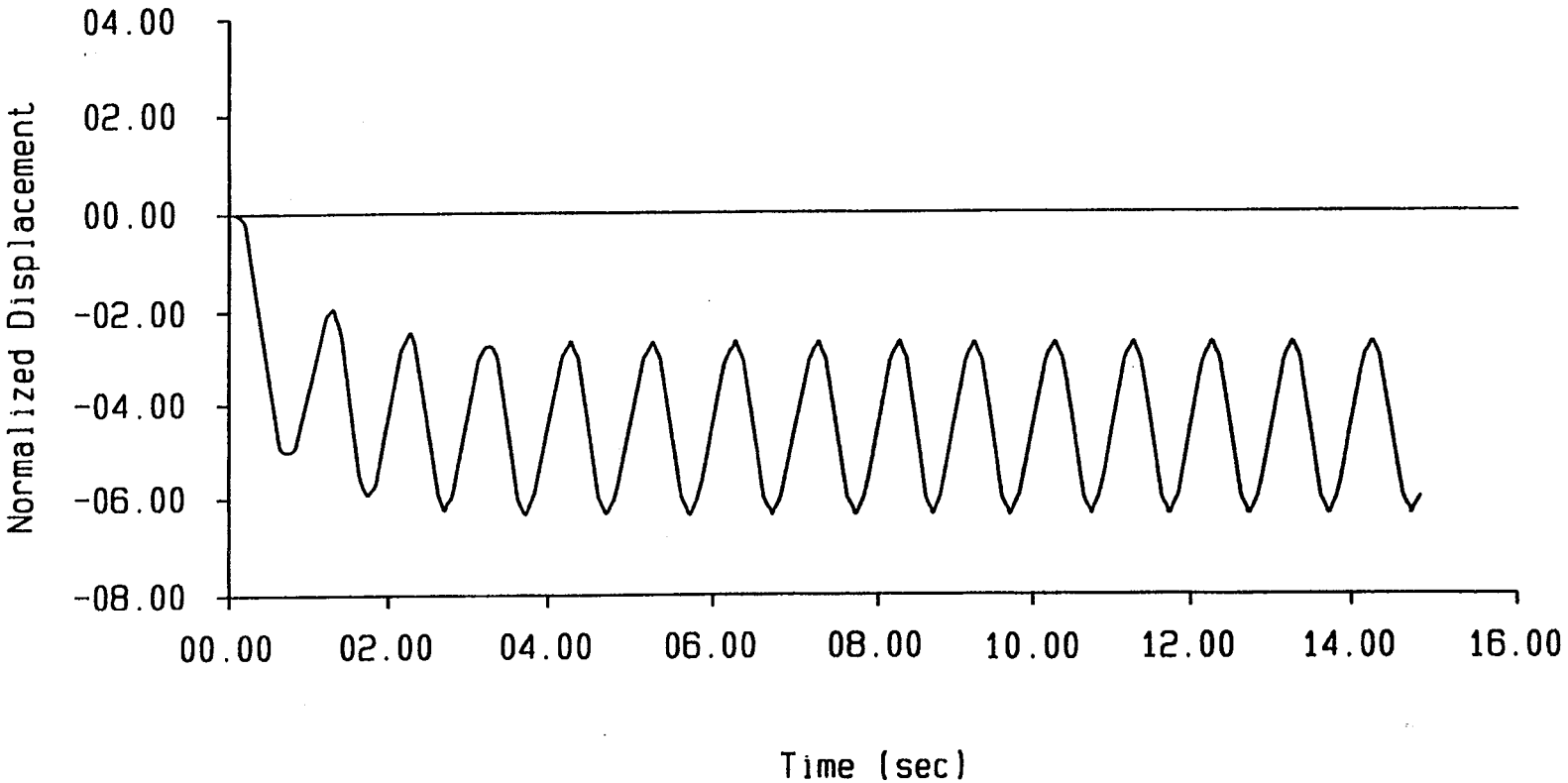
FIG. 38 is a graph showing the displacement-time history of the mass-resistance model of FIG. 31 in response to a sinusoidal loading.
Figure 39:
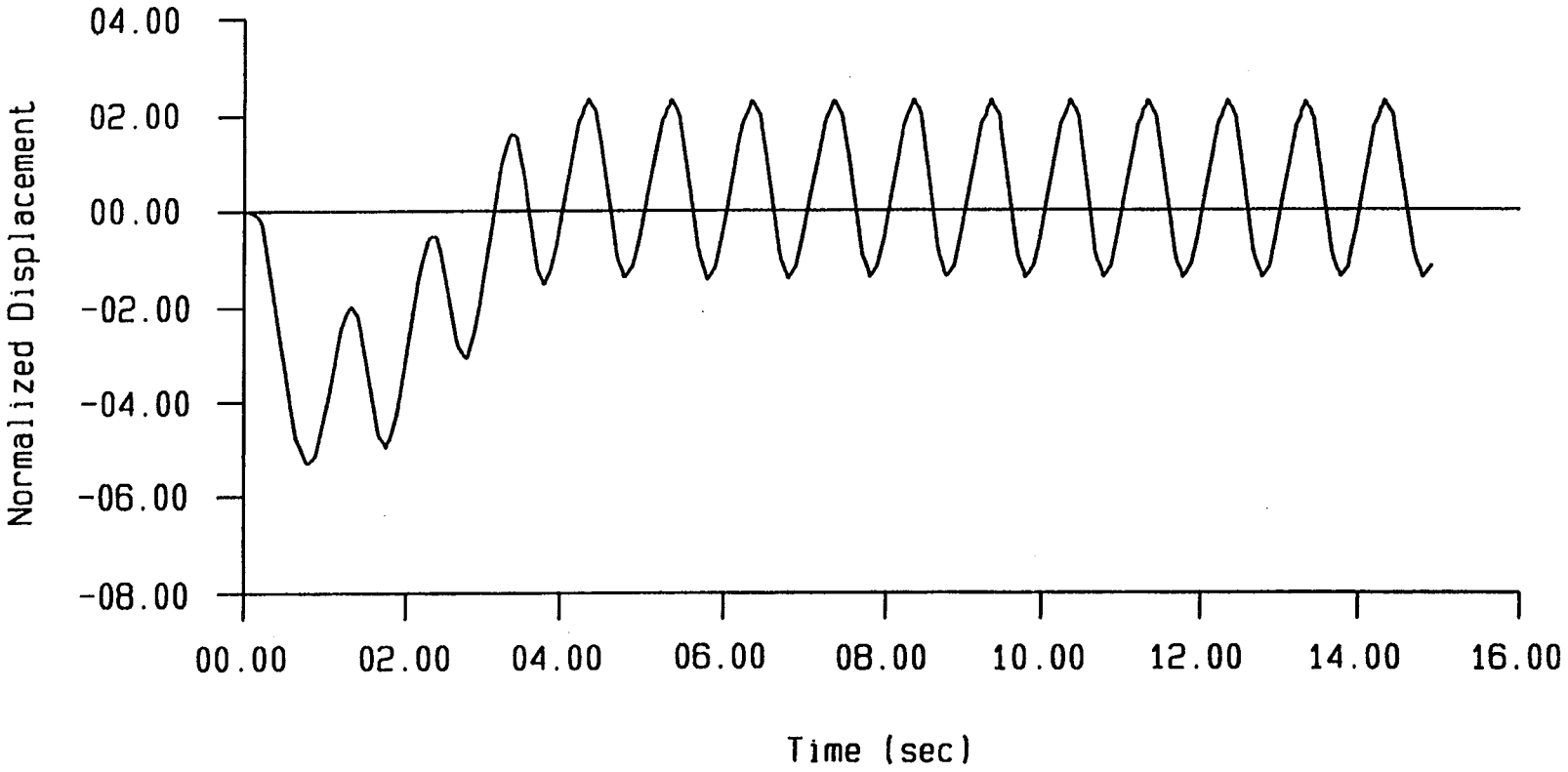
FIG. 39 is a graph showing the displacement-time history of the mass-resistance model of FIG. 32 in response to a sinusoidal loading.

System 1 shows the standard elasto-plastic loading-path (FIG. 36), and the displacement time history (FIG. 34) demonstrates a characteristic steady state response centered on the value of the peak permanent deformation. Such differences in the response between standard and sequentially connected systems have also been observed when the exciting function is periodic. FIGS. 38 and 39 show the displacement time histories for the two systems in response to a sinusoidal input.

As illustrated by FIGS. 34–39, lateral support systems having sequential connections exhibit drastically improved responses to dynamic lateral loads. Accordingly, sequential connections offers an entirely new and until now unexplored avenue in the design of structures that are subject to dynamic excitation. The introduction of this innovation provides additional "degrees of freedom" to the designer to achieve optimal solutions to resist seismic or periodic excitation. An example of such optimization is shown in FIG. 40 which explores the effect of "partitioning" the total resistance "R" of System 1 into $$R_A+R_B=R$$

where $$R_B/R_A=\alpha$$

In the numerical example, I used the optimal value of $\alpha=0.50$ which is the value of $\alpha$ corresponding to the minimum response of System 2.

In the design of multistory structures, there is a further opportunity to combine a large number of sequential components and to select appropriate values for the partition parameter $\alpha$ for each unit. Optimization can also be performed with respect to the dimension of the initial gap. These variations also offer an opportunity to influence the initial elastic response by affecting the elastic period and the mode shape of the response, in addition to the ductile response.

The numerical example above shows a considerable difference in the peak response of the two systems, composed of identical structural elements. Sequential connections may also be used, however, to reduce the quantity of structural material required to achieve an acceptable response to lateral loading.

Figure 41:
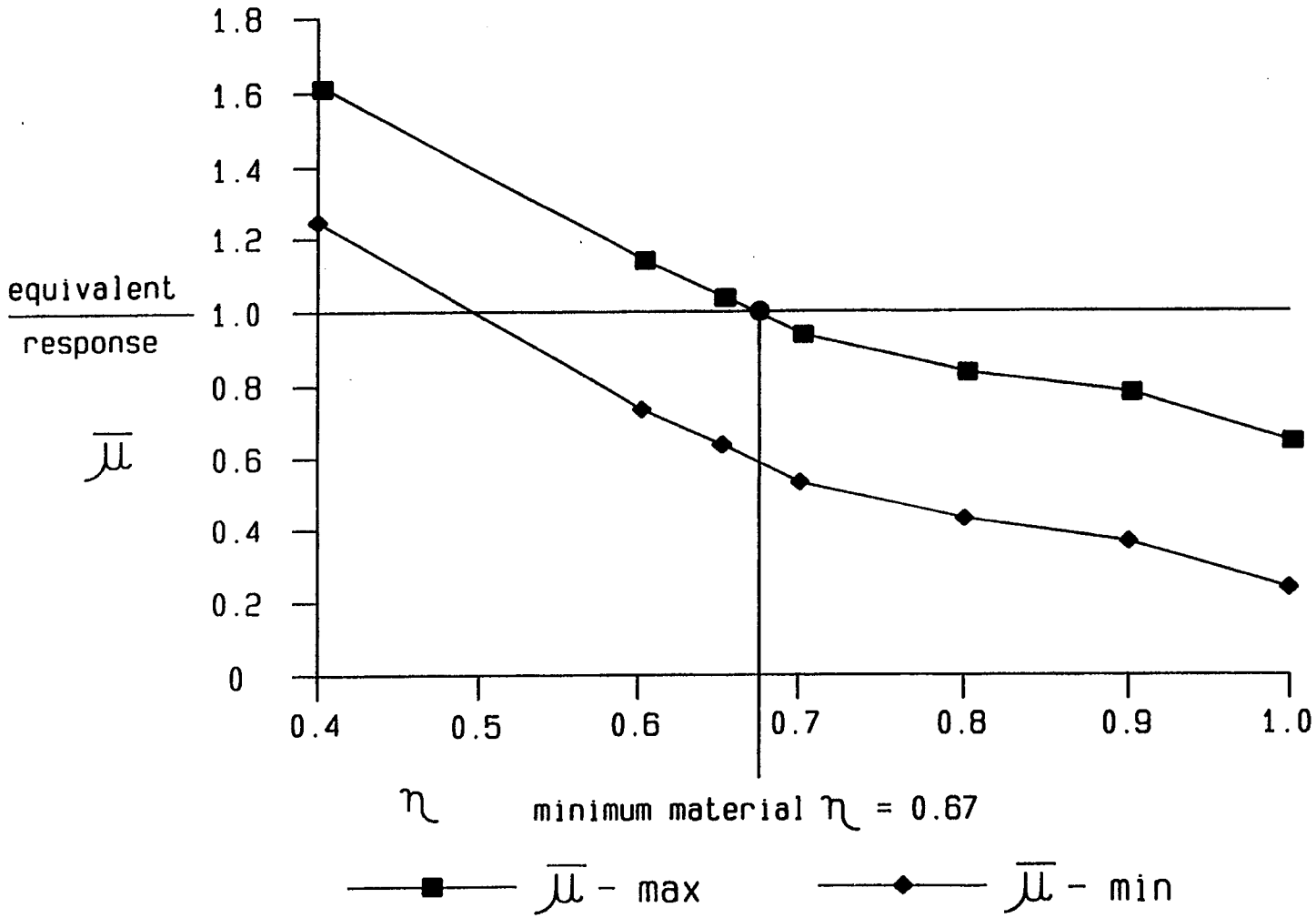
FIG. 41 is a parametric optimization of the material required to resist seismic excitation, using sequential connections according to my invention.

The quantity of steel used in a lateral support structure is directly proportional to the value of $$AL=(A_A+A_B)L$$

where $A_A$ and $A_B$ are the cross sectional areas of the diagonal bracing members and L is their length. FIG. 41 is a parametric exploration of the ratio of the peak deformation responses ($\mu$) of System 1 and a modified System 2a, where the amount of material used is a fraction $\eta$ of System 2, i.e., $$\text{System 1 material}=AL$$

$$\text{System 2a material}=\eta\ AL.$$

FIG. 41 illustrates that the value $\eta=0.67$ corresponds to $\mu_{max}=1$, i.e., the peak deformation response of Systems 1 and 2a are identical. Accordingly, if the performance of the standard System 1 is acceptable, then the identical performance of a sequentially connected System 2a is obtained where the amount of lateral force resisting material is reduced by 33%.

Attached hereto as Appendix A is a paper I have written entitled Sequential Coupling—A New Structural Connection For Seismic Control. The disclosure of Appendix A is incorporated herein by reference to supplement an understanding of a sequential system's response to lateral loads and an appreciation of the additional design parameters available to a structural designer as a result of the invention disclosed in the instant application.

While the invention has been described in conjunction with specific embodiments, it is evident that numerous alternatives, modifications, and variations will be apparent to those skilled in the art in light of the foregoing descriptions.

I claim:

1. A lateral force resisting structure comprising:

first and second structural members lying in a common plane, said members having first and second ends, said first ends being secured to an exterior support structure;

a third structural member having a first end connected to said first structural member and a second end connected to said second structural member;

means for movably connecting said third member to said first member to provide substantially frictionless relative motion between said first member and said third member in response to a lateral load; and structural means for confining said substantially frictionless relative motion, whereby relative motion between said first member and said third member is substantially frictionless until said confining means is reached.

2. The lateral force resisting structure of claim 1 wherein said connecting means comprise:

at least one plate member secured to said first structural member, said plate member having at least one elongated slot for receiving a fastener;

at least one mounting hole in the first end of said third structural member for receiving a fastener, said mounting hole being aligned with said elongated slot in said plate member when said third structural member is connected to said plate member; and at least one fastener extending through said mounting hole in the first end of said third structural member and said elongated slot in said plate member for connecting said third structural member to said plate member, said fastener being located at a predetermined distance from end portions of said elongated slot to provide relative motion between said third structural member and said plate member.

3. The lateral force resisting structure of claim 2 wherein said elongated slot in said plate member extend along the longitudinal axis of said third structural member.

4. The lateral force resisting structure of claim 2 wherein said predetermined distance between said fastener and said end portions of said elongated slot permits said third structural member to displace relative to said plate member in response to a lateral load.

5. The lateral force resisting structure of claim 4 wherein said third structural member comprises:

a primary member having a first end secured to said first structural member and a second end secured to said second structural member; and a secondary member substantially parallel to said primary member, having a first end movably connected to said first structural member and a second end secured to said second member.

6. The lateral force resisting structure of claim 4 wherein said plate member has a plurality of elongated slots and wherein a plurality of mounting holes are provided in the first end of said third structural member for receiving fasteners.

7. The lateral force resisting structure of claim 1 wherein said third structural member comprises reinforced concrete having reinforcing bars, each of said reinforcing bars extending from a first end at said first structural member to a second end at said second structural member.

8. A lateral force resisting structure comprising:

first and second substantially vertical structural members, said members having first and second ends, said first ends being secured to an exterior support structure;

a third structural member having a first end connected to said first structural member and a second end connected to said second structural member, thereby forming a frame;

a primary lateral bracing member having a first end secured to one end of said first structural member and a second end secured to an opposite end of said second structural member;

a secondary lateral bracing member, substantially parallel to said primary lateral bracing member, having a first end connected to said one end of said first structural member and a second end connected to said opposite end of said second structural member; and means for movably connecting at least one end of said secondary lateral bracing member to one of said substantially vertical structural members so as to provide selective longitudinal motion of said secondary lateral bracing member relative to said primary lateral bracing member in response to a lateral load.

9. The lateral force resisting structure of claim 8 wherein said connecting means movably connects the first end of said secondary lateral bracing member to the first end of said first structural member.

10. The lateral force resisting structure of claim 9 wherein said connecting means comprise:

at least one plate member secured to the first end of said first structural member for securing the first end of said secondary lateral bracing member to said first structural member.

11. The lateral force resisting structure of claim 10 wherein said connecting means further comprise:

at least one elongated slot in said plate member for receiving a fastener;

at least one mounting hole in the first end of said secondary lateral bracing member for receiving a fastener, said mounting hole being aligned with said elongated slot in said plate member when said secondary lateral bracing member is connected to said plate member; and at least one fastener extending through said mounting hole in the first end of said secondary lateral bracing member and said elongated slot in said plate member for connecting said secondary lateral bracing member to said plate member, wherein said fastener is located a predetermined distance from end portions of said elongated slot to provide selective longitudinal motion of said secondary lateral bracing member relative to said primary lateral bracing member.

12. The lateral force resisting structure of claim 11 wherein said elongated slot in said plate member extend along the longitudinal axis of said secondary lateral bracing member.

13. The lateral force resisting structure of claim 12 wherein said plate member has a plurality of elongated slots and wherein a plurality of mounting holes are provided in the first end of said secondary lateral bracing member.

14. The lateral force resisting structure of claim 13 wherein said secondary lateral bracing member comprises a plate.

15. The lateral force resisting structure of claim 8 wherein said connecting means movably connects the second end of said secondary lateral bracing member to the second end of said second structural member.

16. The lateral force resisting structure of claim 15 wherein said connecting means comprise:

at least one plate member secured to the second end of said second structural member for securing the second end of said secondary lateral bracing member to said second structural member.

17. The lateral force resisting structure of claim 16 wherein said connecting means further comprise:

at least one elongated slot in said plate member for receiving a fastener;

at least one mounting hole in the second end of said secondary lateral bracing member for receiving a fastener, said mounting hole being aligned with said elongated slot in said plate member when said secondary lateral bracing member is connected to said plate member; and at least one fastener extending through said mounting hole in the second end of said secondary lateral bracing member and said elongated slot in said plate member for connecting said secondary lateral bracing member to said plate member, wherein said fastener is located a predetermined distance from end portions of said elongated slot to provide selective longitudinal motion of said secondary lateral bracing member relative to said primary lateral bracing member.

18. The lateral force resisting structure of claim 17 wherein said elongated slots in said plate member extend along the longitudinal axis of said secondary lateral bracing member.

19. The lateral force resisting structure of claim 18 wherein said plate member has a plurality of elongated slots and wherein a plurality of mounting holes are provided in the first end of said secondary lateral bracing member.

20. The lateral force resisting structure of claim 19 wherein said secondary lateral bracing member comprises a plate.

* * * * *